US008162783B2

(12) United States Patent
Martin

(10) Patent No.: US 8,162,783 B2
(45) Date of Patent: Apr. 24, 2012

(54) TABLE TENNIS GAME WITH AUTOMATED SERVING AND SCOREKEEPING

(76) Inventor: Steven D. Martin, Santa Clara, CA (US)

( * ) Notice: Subject to any disclaimer, the term of this patent is extended or adjusted under 35 U.S.C. 154(b) by 77 days.

(21) Appl. No.: 12/846,739

(22) Filed: Jul. 29, 2010

(65) Prior Publication Data

US 2011/0092320 A1 Apr. 21, 2011

Related U.S. Application Data

(60) Provisional application No. 61/253,005, filed on Oct. 19, 2009.

(51) Int. Cl.
*A63B 69/00* (2006.01)

(52) U.S. Cl. ..... 473/475

(58) Field of Classification Search ..... 473/475, 473/496; 124/1, 6, 56, 59, 72
See application file for complete search history.

(56) References Cited

U.S. PATENT DOCUMENTS 3,807,379 A * 4/1974 Vodinh ..... 124/26
3,999,754 A * 12/1976 Krzysztofiak et al. ..... 473/431
4,002,336 A * 1/1977 Beaver et al. ..... 473/431
4,765,618 A 8/1988 Daley
4,886,269 A * 12/1989 Marocco ..... 473/431
5,265,583 A * 11/1993 Otto ..... 124/81
5,383,658 A * 1/1995 Newgarden, Jr. ..... 473/475
5,485,995 A * 1/1996 Newgarden, Jr. ..... 124/49
6,012,995 A 1/2000 Martin
6,186,132 B1 * 2/2001 Ko ..... 124/6
6,200,236 B1 * 3/2001 Minami et al. ..... 473/496
6,371,872 B1 * 4/2002 Daley ..... 473/460
6,383,097 B2 * 5/2002 Minami et al. ..... 473/496
6,406,386 B1 * 6/2002 Brazzell ..... 473/431
6,604,517 B1 * 8/2003 Chao et al. ..... 124/16
6,691,691 B1 2/2004 Beynon et al.
7,350,515 B2 * 4/2008 Yao et al. ..... 124/51.1
2001/0006915 A1 7/2001 Minami et al.
2007/0221187 A1 * 9/2007 Chen ..... 124/59
2011/0092320 A1 * 4/2011 Martin ..... 473/475

* cited by examiner

*Primary Examiner* — Raleigh W. Chiu
(74) *Attorney, Agent, or Firm* — Carr & Ferrell LLP

(57) ABSTRACT

A table tennis game table may include one or more automated ball serving guns and an automated score announcing system. Remote control actuators may be provided for one or more users to operate the features of the table. The system may be adjusted manually or remotely to correct mistakes, and may be used in multiple modes. Alternatively, the automated ball serving guns and automated score announcing system may be adapted to a standard after market table.

33 Claims, 42 Drawing Sheets

Four Serving Guns Fed By Four Bucket Motors
(Top View)

Four Serving Guns Fed By Four Bucket Motors
(Side View 1)

Four Serving Guns Fed By Four Bucket Motors
(Side View 2)

Two Serving Guns Fed By Two Bucket Motors
(Top View)

Two Serving Guns Fed By Two Bucket Motors
(Side View)

After Market Table With Serving Machines Positioned On The Floor

Four Serving Guns Fed By One Bucket Motor and Ball Routing Switch
(Top View)

Four Serving Guns Fed By One Bucket Motor and Ball Routing Switch

(Side View 1)

Four Serving Guns Fed By One Bucket Motor and Ball Routing Switch
(Side View 2)

Player's View Of Two Shooter Pong Buckets and Ball Display Tubes

Shooter Pong For Family Chores

| | | | | | | | | | | | |
|---|---|---|---|---|---|---|---|---|---|---|---|
| Clean the Toilets | Clean The Cat Box | Take Out Trash | Clean The Pool | Make the Beds | Free Pass | Mow the Lawn | Wash the Dishes | Wash the Car | Vacuum the House | Game Winner | 1 |
| Vacuum the House | Clean The Pool | Make the Beds | Wash the Dishes | Take Out Trash | Wash the Car | Clean the Toilets | Clean The Cat Box | Free Pass | Mow the Lawn | Game Winner | 2 |
| Take Out Trash | Free Pass | Clean the Toilets | Make the Beds | Clean The Pool | Wash the Dishes | Wash the Car | Vacuum the House | Mow the Lawn | Clean The Cat Box | Game Winner | 3 |
| Vacuum the House | Wash the Car | Mow the Lawn | Free Pass | Make the Beds | Clean The Pool | Take Out Trash | Wash the Dishes | Clean The Cat Box | Clean the Toilets | Game Winner | 4 |
| Clean The Pool | Wash the Dishes | Clean the Toilets | Take Out Trash | Free Pass | Make the Beds | Clean The Cat Box | Mow the Lawn | Vacuum the House | Wash the Car | Game Winner | 5 |
| Clean the Toilets | Vacuum the House | Free Pass | Clean The Cat Box | Take Out Trash | Mow the Lawn | Make the Beds | Free Pass | Wash the Dishes | Clean The Pool | Game Winner | 6 |
| Clean The Cat Box | Clean the Toilets | Clean The Pool | Mow the Lawn | Wash the Dishes | Free Pass | Vacuum the House | Make the Beds | Wash the Car | Take Out Trash | Game Winner | 7 |
| Wash the Dishes | Mow the Lawn | Clean The Cat Box | Clean the Toilets | Vacuum the House | Make the Beds | Wash the Car | Take Out Trash | Clean The Pool | Free Pass | Game Winner | 8 |
| Wash the Car | Clean The Cat Box | Take Out Trash | Free Pass | Make the Beds | Clean The Pool | Clean the Toilets | Wash the Dishes | Free Pass | Vacuum the House | Game Winner | 9 |
| Make the Beds | Mow the Lawn | Vacuum the House | Wash the Car | Clean the Toilets | Wash the Dishes | Free Pass | Clean The Pool | Take Out Trash | Clean The Cat Box | Game Winner | 10 |

Fig. 26

Shooter Pong For Charity Events

| | | | | | | | | | | | |
|---|---|---|---|---|---|---|---|---|---|---|---|
| $25 Donation | $5 Donation | $250 Donation | $15 Donation | $50 Donation | $100 Donation | $150 Donation | $10 Donation | $20 Donation | $90 Donation | Game Winner | 1 |
| $250 Donation | $50 Donation | $25 Donation | $150 Donation | $500 Donation | $200 Donation | $15 Donation | $100 Donation | $200 Donation | $10 Donation | Game Winner | 2 |
| $30 Donation | $20 Donation | $25 Donation | $15 Donation | $50 Donation | $10 Donation | $15 Donation | $70 Donation | $20 Donation | $25 Donation | Game Winner | 3 |
| $25 Donation | $5 Donation | $40 Donation | $30 Donation | $10 Donation | $1 Donation | $70 Donation | $20 Donation | $5 Donation | $10 Donation | Game Winner | 4 |
| $25 Donation | $5 Donation | $250 Donation | $15 Donation | $50 Donation | $100 Donation | $150 Donation | $10 Donation | $20 Donation | $90 Donation | Game Winner | 5 |
| $2 Donation | $1 Donation | $25 Donation | $3 Donation | $25 Donation | $10 Donation | $15 Donation | $120 Donation | $200 Donation | $10 Donation | Game Winner | 6 |
| $5 Donation | $25 Donation | $40 Donation | $150 Donation | $500 Donation | $60 Donation | $10 Donation | $35 Donation | $25 Donation | $75 Donation | Game Winner | 7 |
| $25 Donation | $1 Donation | $80 Donation | $75 Donation | $45 Donation | $120 Donation | $100 Donation | $110 Donation | $35 Donation | $15 Donation | Game Winner | 8 |
| $250 Donation | $10 Donation | $45 Donation | $65 Donation | $60 Donation | $150 Donation | $500 Donation | $15 Donation | $80 Donation | $10 Donation | Game Winner | 9 |
| $250 Donation | $500 Donation | $25 Donation | $15 Donation | $300 Donation | $150 Donation | $10 Donation | $25 Donation | $40 Donation | $30 Donation | Game Winner | 10 |

Fig. 27

Shooter Pong For Parties

| | | | | | | | | | | | |
|---|---|---|---|---|---|---|---|---|---|---|---|
| 1 Shot Beverage | ½ Shot Beverage | 1 Power Belch | 1 Shot Beverage | One full 12 ounce Beverage | Free Pass | 1 Shot Beverage | ½ Shot Beverage | ¼ Shot Beverage | 1/4 12 ounce Beverage | Game Winner | 1 |
| 1 Power Belch | 1/4 12 ounce Beverage | 1 Shot Beverage | ½ Shot Beverage | 1/2 12 ounce Beverage | 1 Shot Beverage | One full 12 ounce Beverage | Free Pass | 1 Shot Beverage | ½ Shot Beverage | Game Winner | 2 |
| ½ Shot Beverage | 1/2 12 ounce Beverage | Free Pass | One full 12 ounce Beverage | Free Pass | 1 Shot Beverage | ¼ Shot Beverage | 1 Power Belch | One full 12 ounce Beverage | 1 Shot Beverage | Game Winner | 3 |
| ¼ Shot Beverage | Free Pass | 1 Shot Beverage | ½ Shot Beverage | 1/2 12 ounce Beverage | ¼ Shot Beverage | Free Pass | 1 Shot Beverage | ½ Shot Beverage | 1/2 12 ounce Beverage | Game Winner | 4 |
| 1 Power Belch | 1/4 12 ounce Beverage | 1 Shot Beverage | ½ Shot Beverage | 1 Shot Beverage | 1 Shot Beverage | 1/2 12 ounce Beverage | 1 Power Belch | Free Pass | One full 12 ounce Beverage | Game Winner | 5 |
| Free Pass | One full 12 ounce Beverage | ¼ Shot Beverage | 1 Shot Beverage | ½ Shot Beverage | 1 Power Belch | One full 12 ounce Beverage | 1 Shot Beverage | 1/2 12 ounce Beverage | ¼ Shot Beverage | Game Winner | 6 |
| ½ Shot Beverage | 1/2 12 ounce Beverage | Free Pass | One full 12 ounce Beverage | Free Pass | One full 12 ounce Beverage | 1 Power Belch | 1/2 12 ounce Beverage | 1/4 12 ounce Beverage | 1/4 12 ounce Beverage | Game Winner | 7 |
| 1/2 12 ounce Beverage | ¼ Shot Beverage | 1 Shot Beverage | Free Pass | ¼ Shot Beverage | Free Pass | 1 Shot Beverage | ½ Shot Beverage | 1/2 12 ounce Beverage | ¼ Shot Beverage | Game Winner | 8 |
| 1 Shot Beverage | ½ Shot Beverage | 1 Power Belch | 1 Shot Beverage | One full 12 ounce Beverage | ½ Shot Beverage | 1/2 12 ounce Beverage | ¼ Shot Beverage | Free Pass | 1 Shot Beverage | Game Winner | 9 |
| ¼ Shot Beverage | 1 Power Belch | One full 12 ounce Beverage | ½ Shot Beverage | Free Pass | 1 Shot Beverage | ¼ Shot Beverage | 1/2 12 ounce Beverage | 1 Power Belch | Free Pass | Game Winner | 10 |

Fig. 28

Note for figures 29-31:
Short Serve = 12 volts through Resistor A + 0 volts through Resistor B (ULN 2068 switch Off)
Long Serve = 12 volts through Resistor A + 12 volts through Resistor B (ULN 2068 switch On)

Serving Gun with Left/Right Pivot Capability and Precision Serve Motor Wheel Speed Control

Serving Gun with Left/Right Pivot Capability and Precision Serve Motor Wheel Speed Control

*This Design could also be used with the fixed serving guns

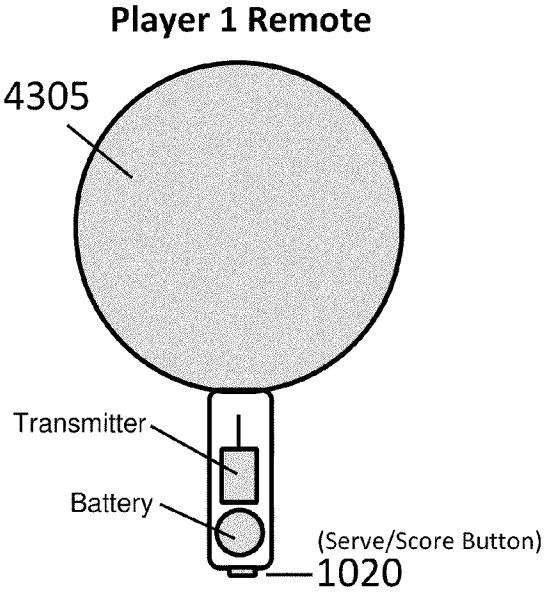
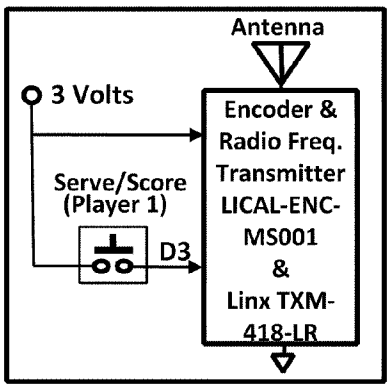
Fig. 43
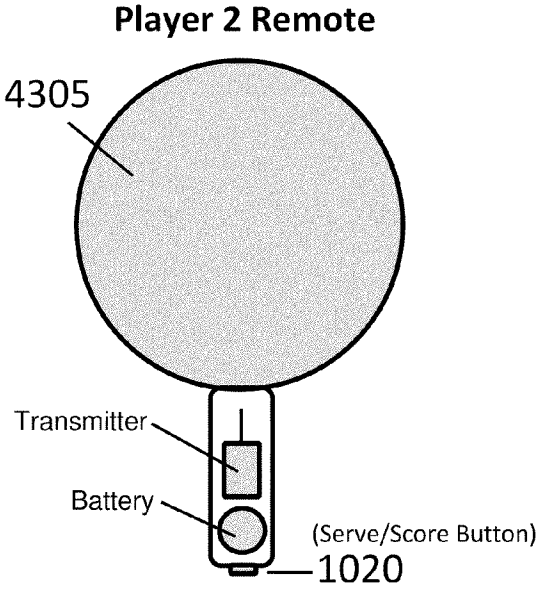
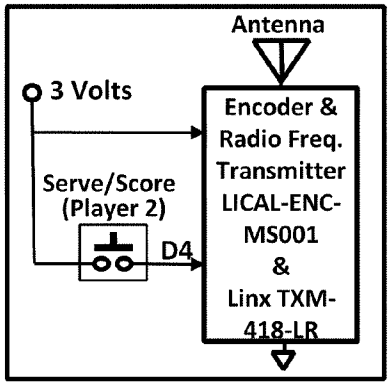
Fig. 44

TABLE TENNIS GAME WITH AUTOMATED SERVING AND SCOREKEEPING

CROSS-REFERENCE TO RELATED APPLICATIONS

The present application claims the priority benefit of U.S. provisional patent application Ser. No. 61/253,005, filed Oct. 19, 2009, the disclosure of which is hereby incorporated by reference.

This application is related to U.S. Pat. No. 6,270,431, issued Aug. 7, 2001, and U.S. Pat. No. 6,012,995, issued Jan. 11, 2000, the disclosures of which are both hereby incorporated by reference.

BACKGROUND OF THE INVENTION

1. Field of the Invention

The present invention relates generally to the game of table tennis and associated equipment. The present invention more particularly relates to a table tennis table with an automated ball serving device and an automatic scoring device.

2. Description of the Related Art

A game of recreational table tennis has at least three intrinsic factors that cause unwanted game delays. These factors include the following:

1. Retrieving the ball between rallies
2. Losing track of the serve-turn
3. Losing track of the score The technology disclosed herein allows users to play table tennis without taking time to retrieve balls. The technology also relieves users of the need to track the score and the proper server.

SUMMARY OF THE INVENTION

The exemplary embodiments described herein allow users to enjoy a modified game of table tennis in which one or more automatic serving guns provide the serving function normally performed by the serving player. The ball may be put in play as fast as a player can trigger the automatic serving function, for example, by tapping a remote control device on his hip. An automated ball serving system may automatically track the serve-turn and cause a serving gun to serve the ball to the correct player. Additionally, the score may be accurately announced by the automated scoring device after each ball is put into play by the serving gun.

The serving guns may each include a propulsion device that directs the ball to an appropriate serve receiving area. A queuing device (e.g., a ball basket) associated with each serving gun holds a plurality of table tennis balls to be served. The automated ball serving system may include a serve-tracking function that instructs the serving device to direct each serve to an appropriate serve receiving area on a table tennis table.

The ball serving system may also include a method to vary the landing spot of the served balls. The system may vary the landing spot by altering the velocity at which the serving guns eject the balls. The system may be programmed to randomly vary the landing spot.

In some embodiments, sensors may provide data for determining the landing point of a served ball. The landing point data may be used to calibrate the serving guns.

In other embodiments, the serving gun may include a sensing device to measure the RPM of the rotation of the wheel. The sensing device may be a phototransistor that includes a light emitting diode (LED), whose light may be reflected off a mirror affixed to the wheel and detected by the phototransistor.

In still other embodiments, the direction in which the balls are served by the serving gun is variable. A variation may be implemented by rotatably mounting the serving guns on the table and controlling rotation of the guns with stepper motors. The rotation of the serving gun, and hence location of the serve, may be controlled by the ball serving system. The location of the serve may be randomly chosen by the system.

A target device may be positioned on the table. The target device may be coupled to a collection device with a mechanism that allows a user to visually determine a number of balls in the collection device.

BRIEF DESCRIPTION OF THE DRAWINGS

FIG. 26 shows an example of a printed penalty label.

FIG. 27 shows an alternative example of a printed penalty label.

FIG. 28 shows another alternative example of a printed penalty label.

FIG. 43 shows an exemplary configuration for a table tennis paddle with a wireless remote inside the paddle handle and the associated diagram of an exemplary circuit using encoder data channel D3 for player one inputs.

FIG. 44 shows an exemplary configuration for a table tennis paddle with a wireless remote inside the paddle handle and the associated diagram of an exemplary circuit using encoder data channel D4 for player two input.

DETAILED DESCRIPTION OF THE INVENTION

An exemplary embodiment is a ball serving system that may include an automated ball serving device and an automated scoring device for a table tennis game. The automated scoring device may include both audio and visual displays and may incorporate aspects of commonly-owned U.S. Pat. No. 6,012,995, titled "Scorekeeping Racket Device with Audio and Visual Display," and U.S. Pat. No. 6,270,431, titled "Control Grid for Table Tennis Scorekeeping Device with Audio and Visual Display," both of which are hereby incorporated by reference. Using both the automated ball serving device and the automated scoring device may eliminate common game delay conditions: retrieving the ball between rallies, losing track of the serve-turn, and losing track of the score.

Figure 1:
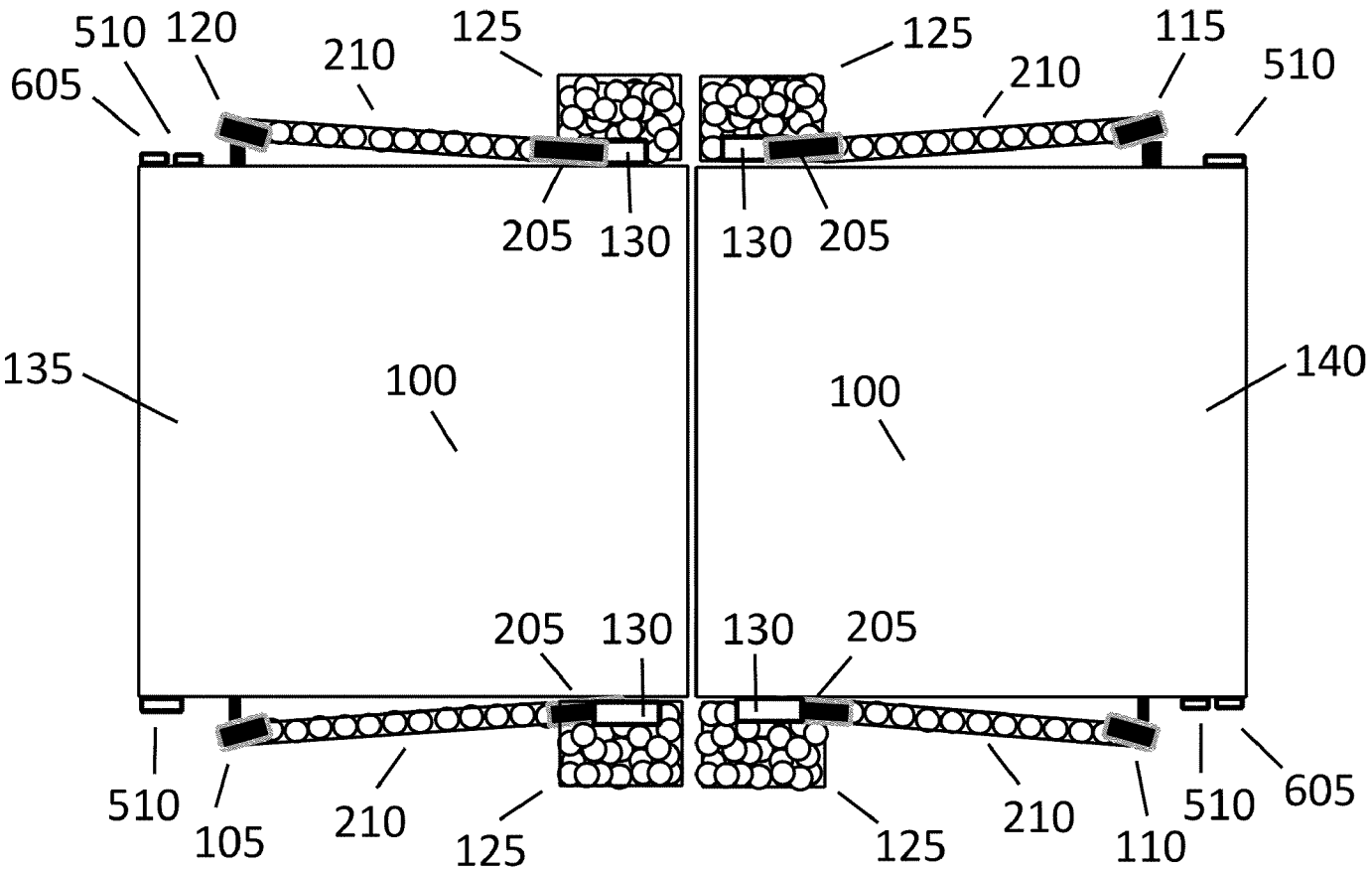
FIG. 1 is a top view of an exemplary table showing four ball bucket motors, four serving guns, and associated ball connection tubes, according to various embodiments.

FIG. 1 shows a top view of a table tennis table 100 utilizing the ball serving system. The table 100 may be equipped with automated ball serving devices (e.g., serving guns 105), and may utilize automated score keeping functions. In the configuration depicted in FIG. 1, four serving guns 105, 110, 115, 120 are used to serve from the four serving areas of the table. Serving gun 105 may be considered the right side serving gun of player one. Serving gun 110 may be considered the left side serving gun of player two. Serving gun 115 may be considered the right side serving gun of player two, and serving gun 120 may be considered the left side serving gun of player one.

Each serving gun may be supplied by a ball bucket 125. The ball bucket 125 may hold a plurality of balls to supply the associated serving gun. In various embodiments of the device, the balls may be fed to the serving guns through elbow tubes 205 that feed into straight feed tubes 210. The elbow tubes 205 and the feed tubes 210 are illustrated with additional detail in FIGS. 2 and 3.

Figure 2:
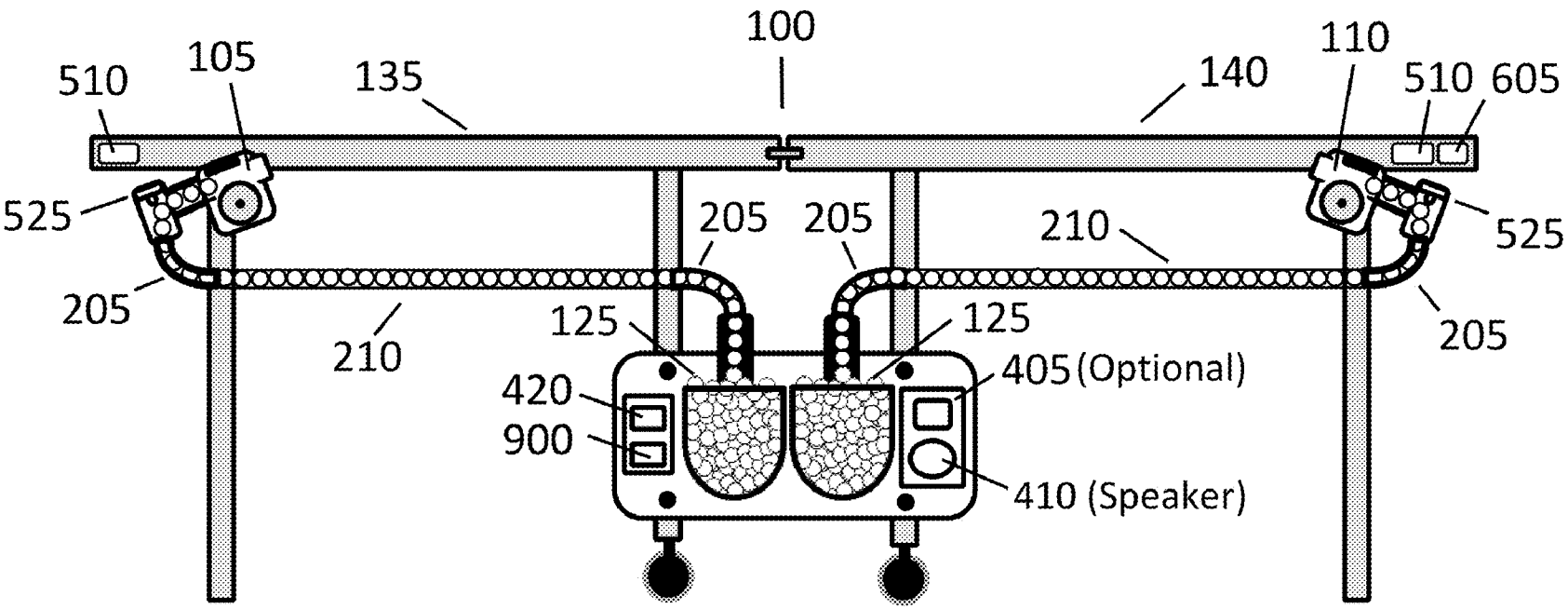
FIG. 2 is a first side view of the table of FIG. 1.
Figure 3:
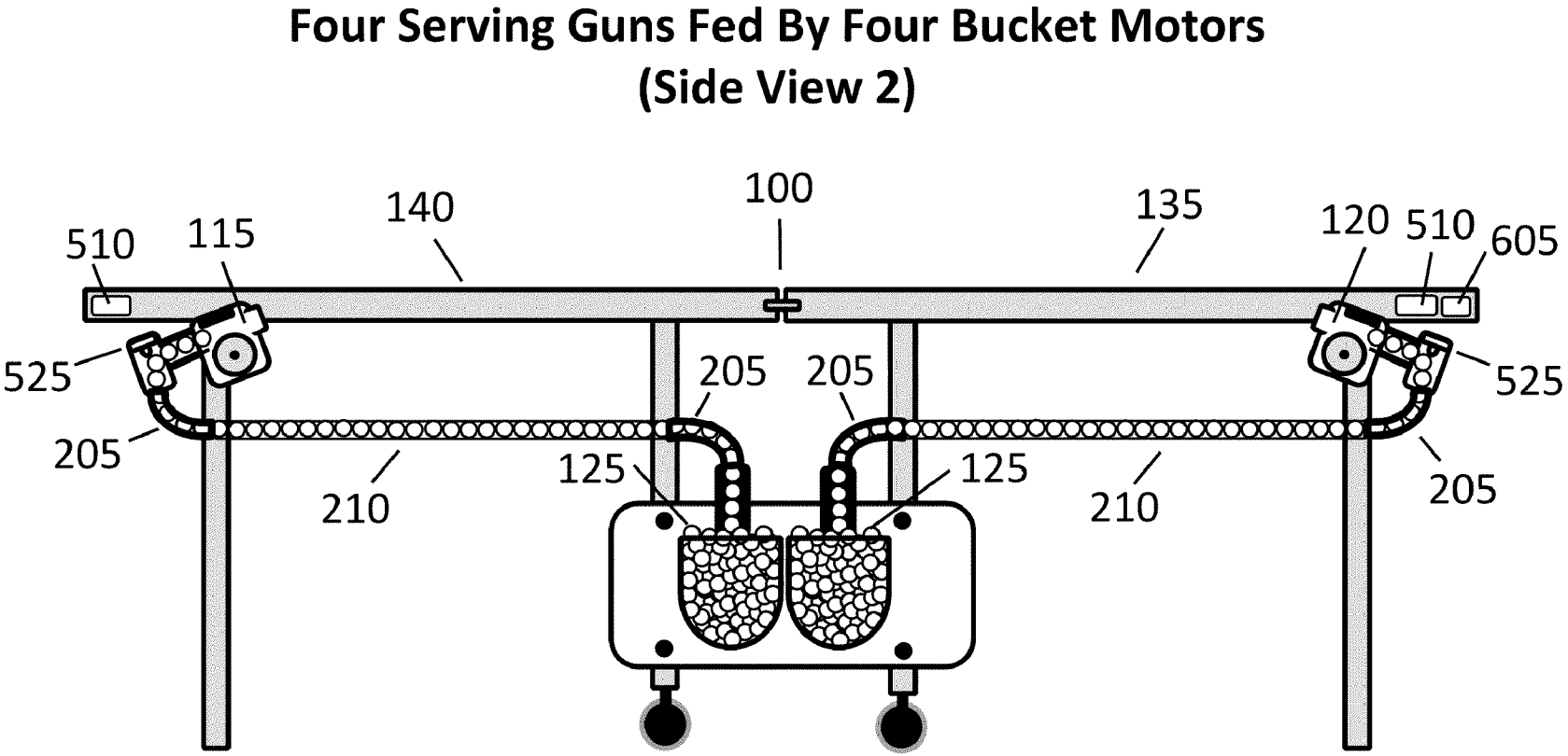
FIG. 3 is a second side view of the table of FIG. 1.
Figure 9:
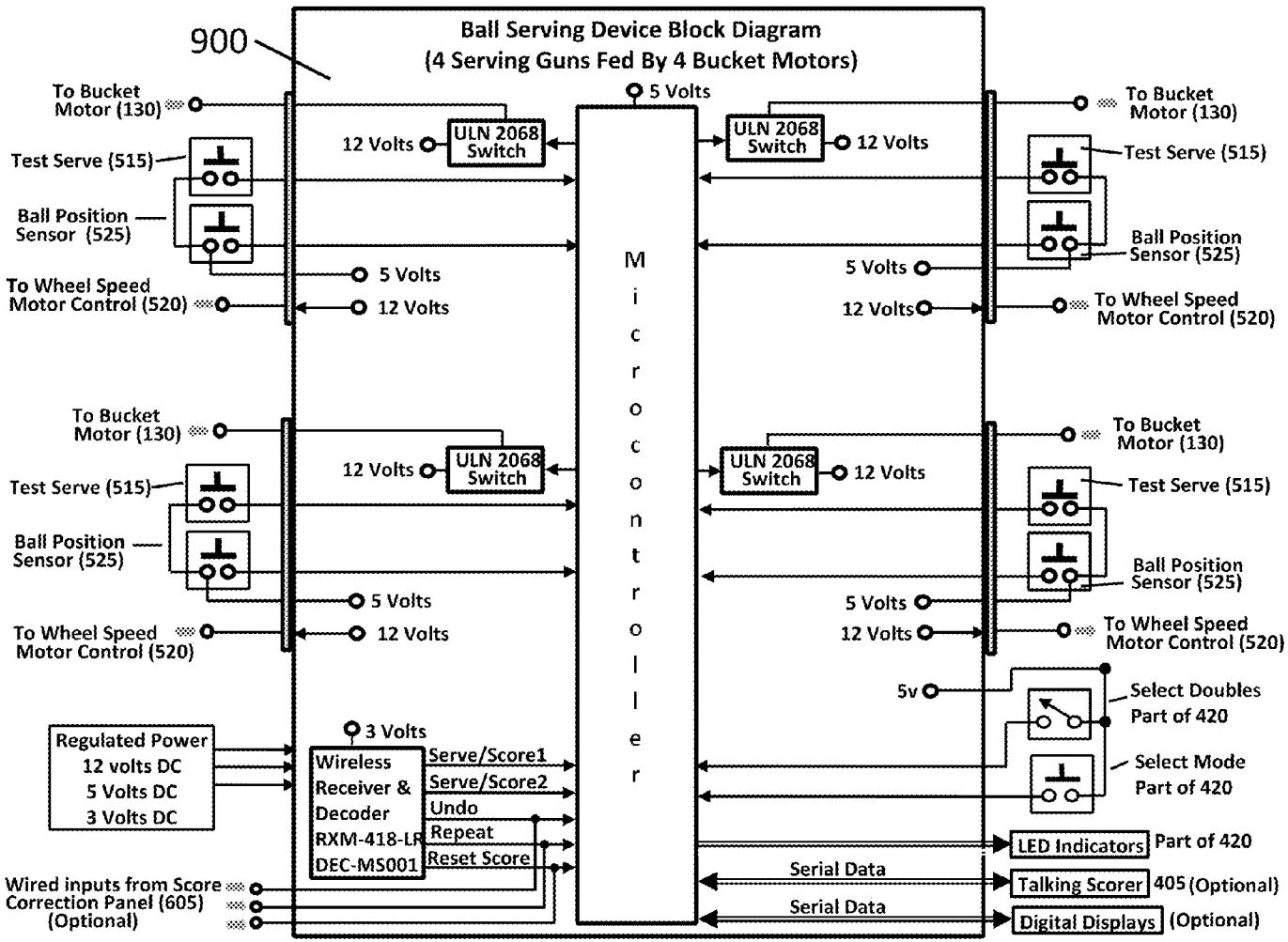
FIG. 9 is a diagram of an exemplary circuit that controls four bucket motors and four serving guns for the ball serving device.

The motive force to move the balls through the tubes 205, 210 and to propel the balls from the serving guns may be provided by a motor 130. FIGS. 1-3 illustrate a configuration of the table 100 in which four motors 130 serve four serving guns. A diagram 900 for an exemplary circuit for the four motor/four gun configuration is illustrated in FIG. 9.

Figure 13:
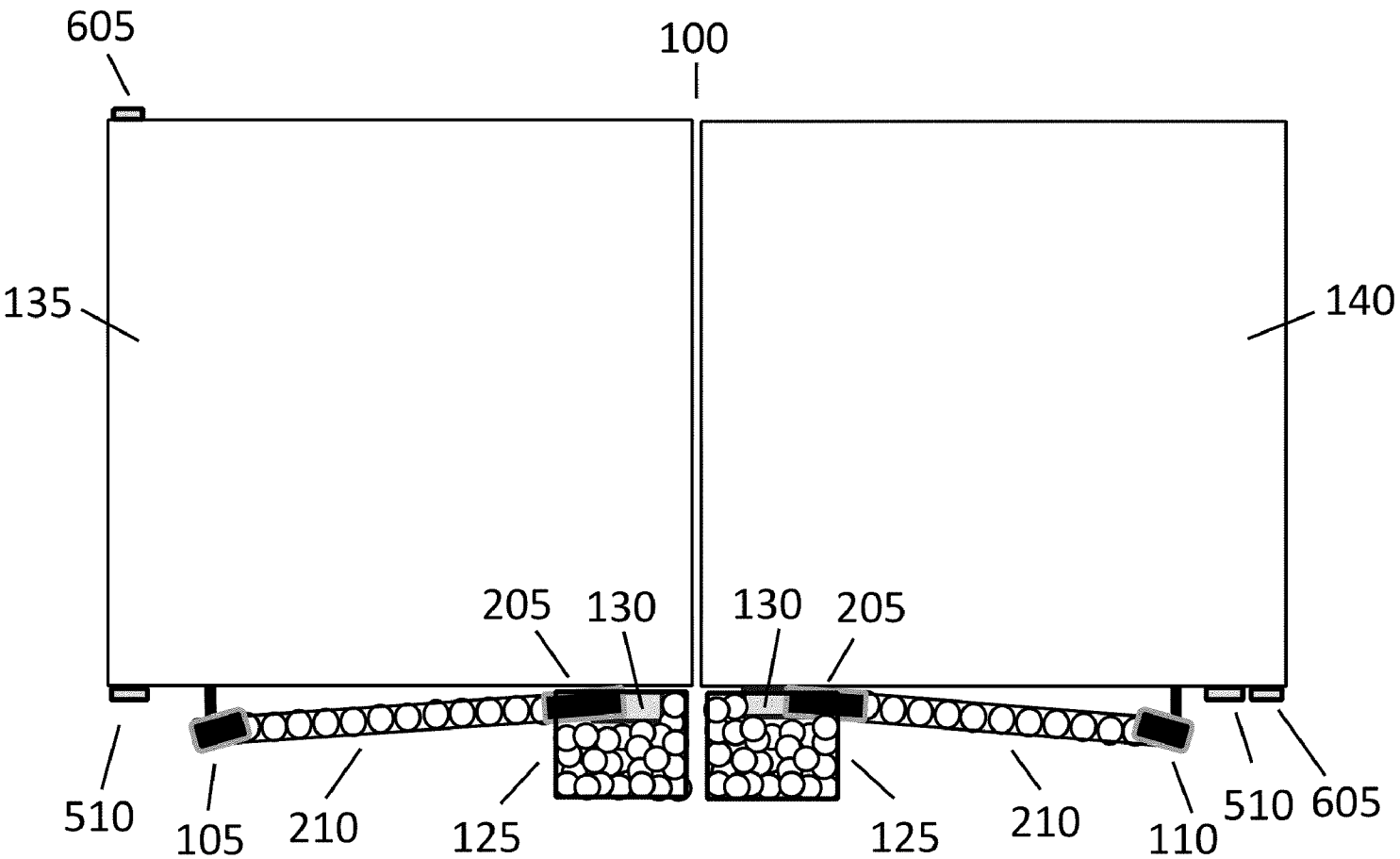
FIG. 13 is a top view of an exemplary embodiment of a table using two serving guns fed by two bucket motors.
Figure 14:
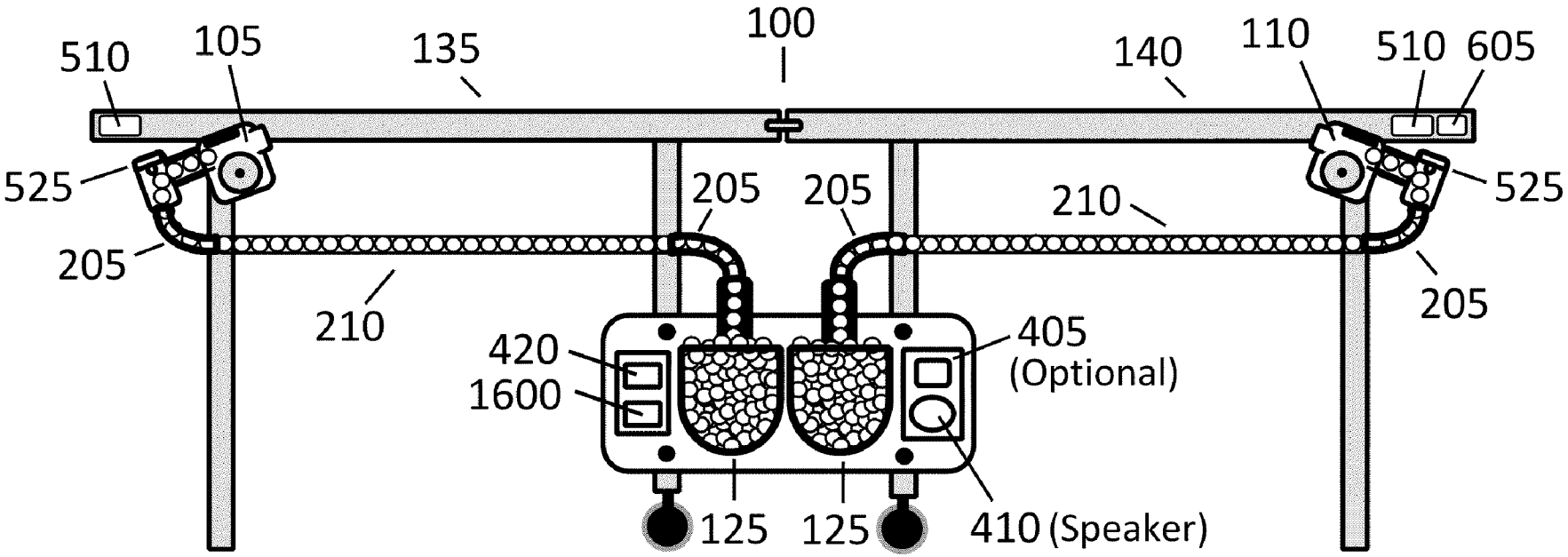
FIG. 14 is a side view of the table of FIG. 13 using two serving guns fed by two bucket motors.
Figure 16:
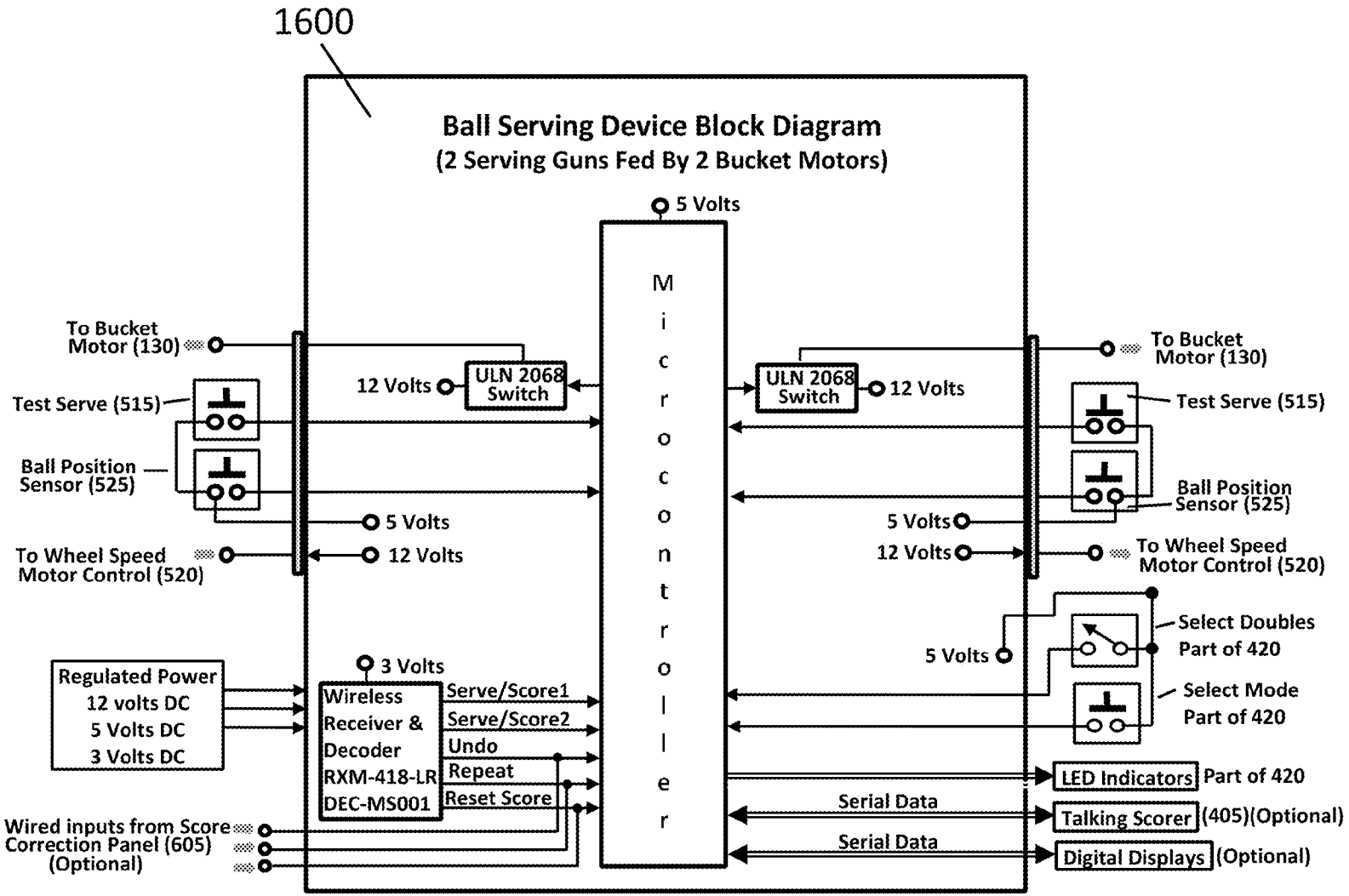
FIG. 16 is a diagram of an exemplary circuit for controlling two serving guns and two bucket motors.
Figure 17:
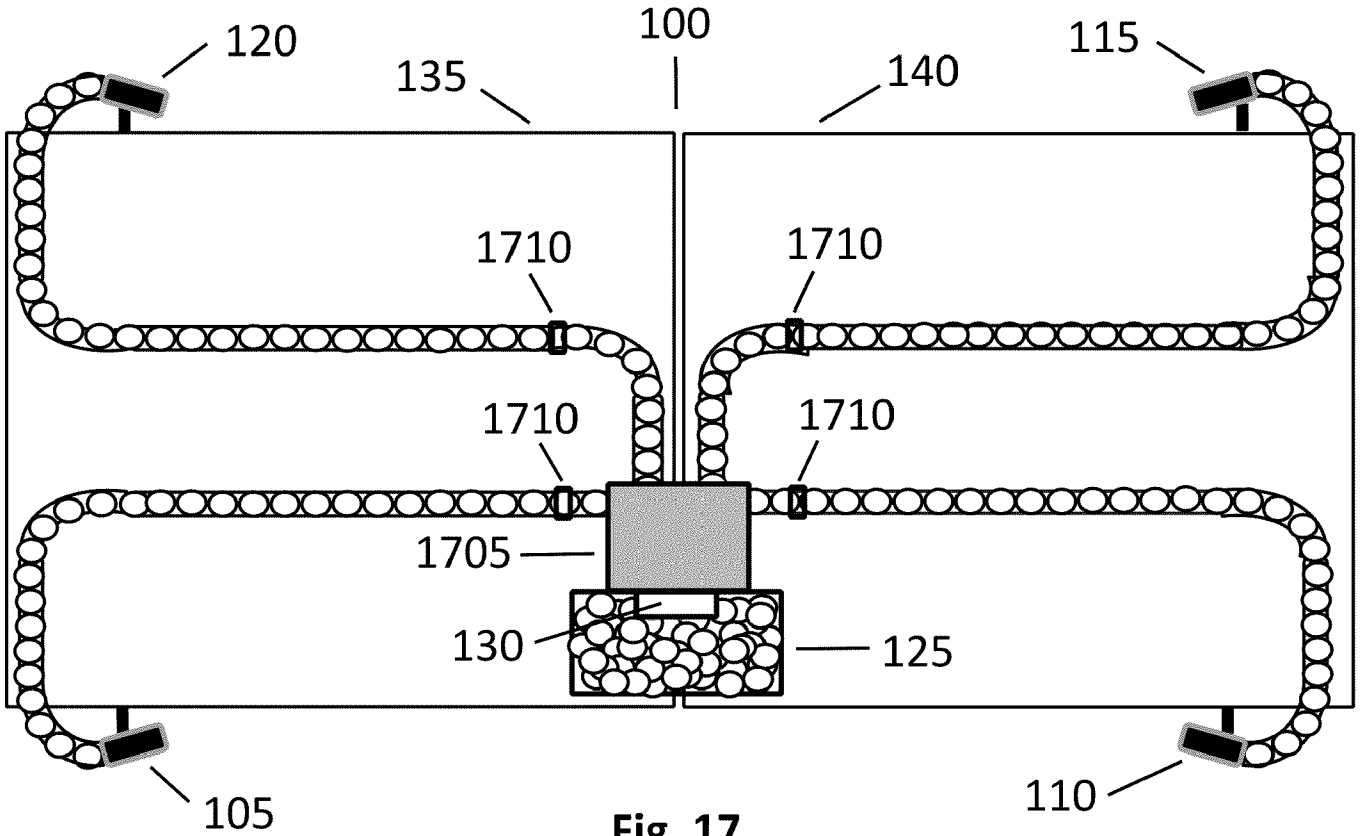
FIG. 17 is a top view of an exemplary table that includes four serving guns fed by one bucket motor and a ball routing switch mechanism.
Figure 18:
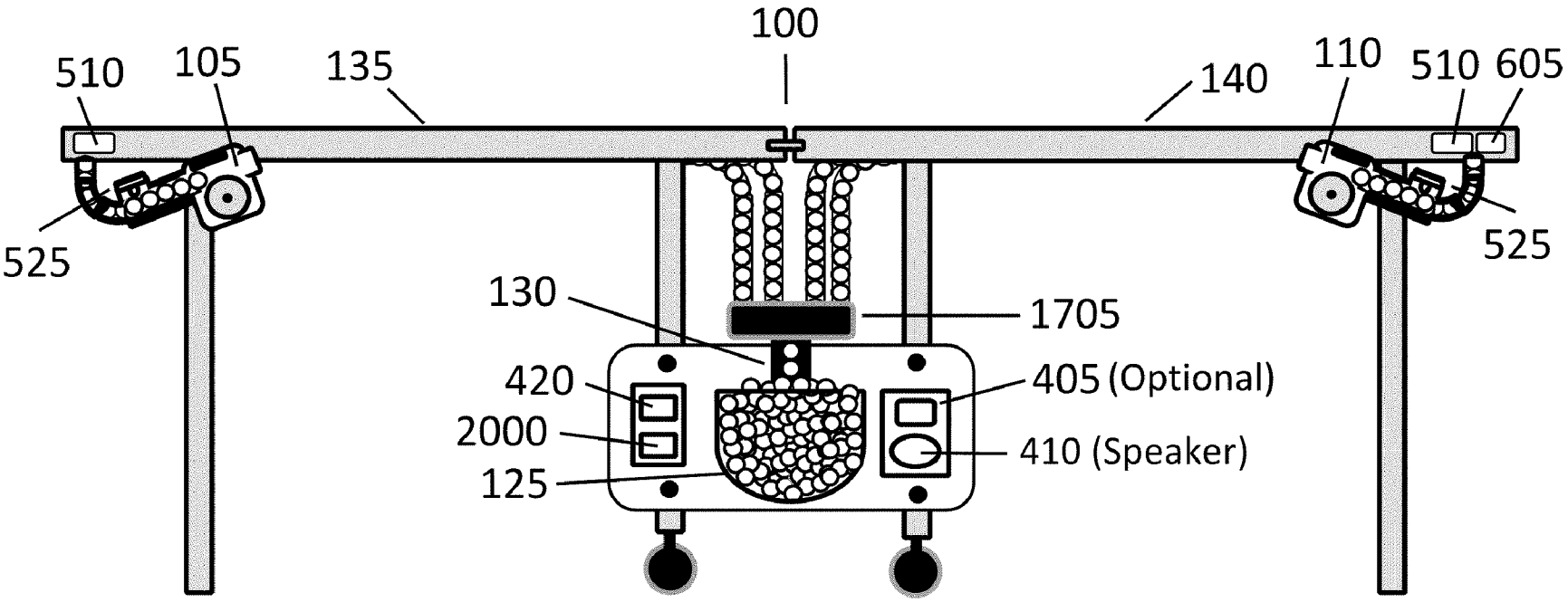
FIG. 18 is a first side view of the table of FIG. 17.
Figure 19:
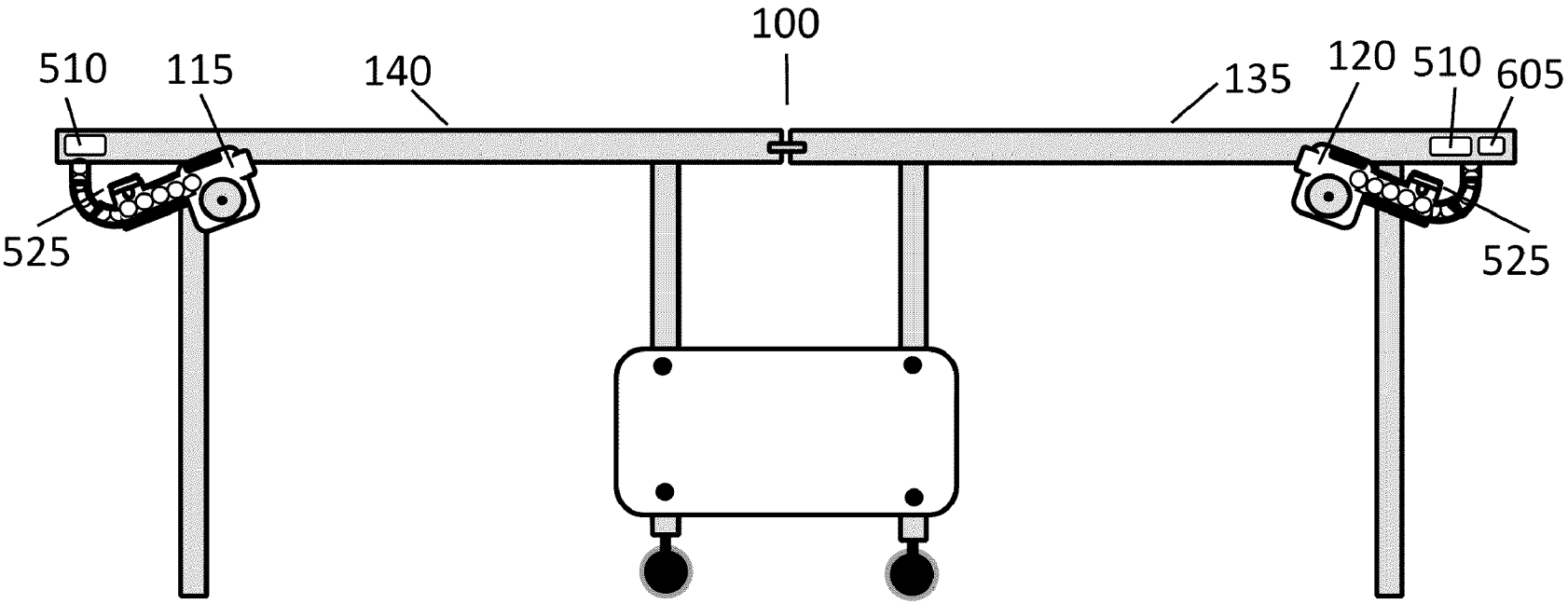
FIG. 19 is a second side view of the table of FIG. 17.
Figure 20:
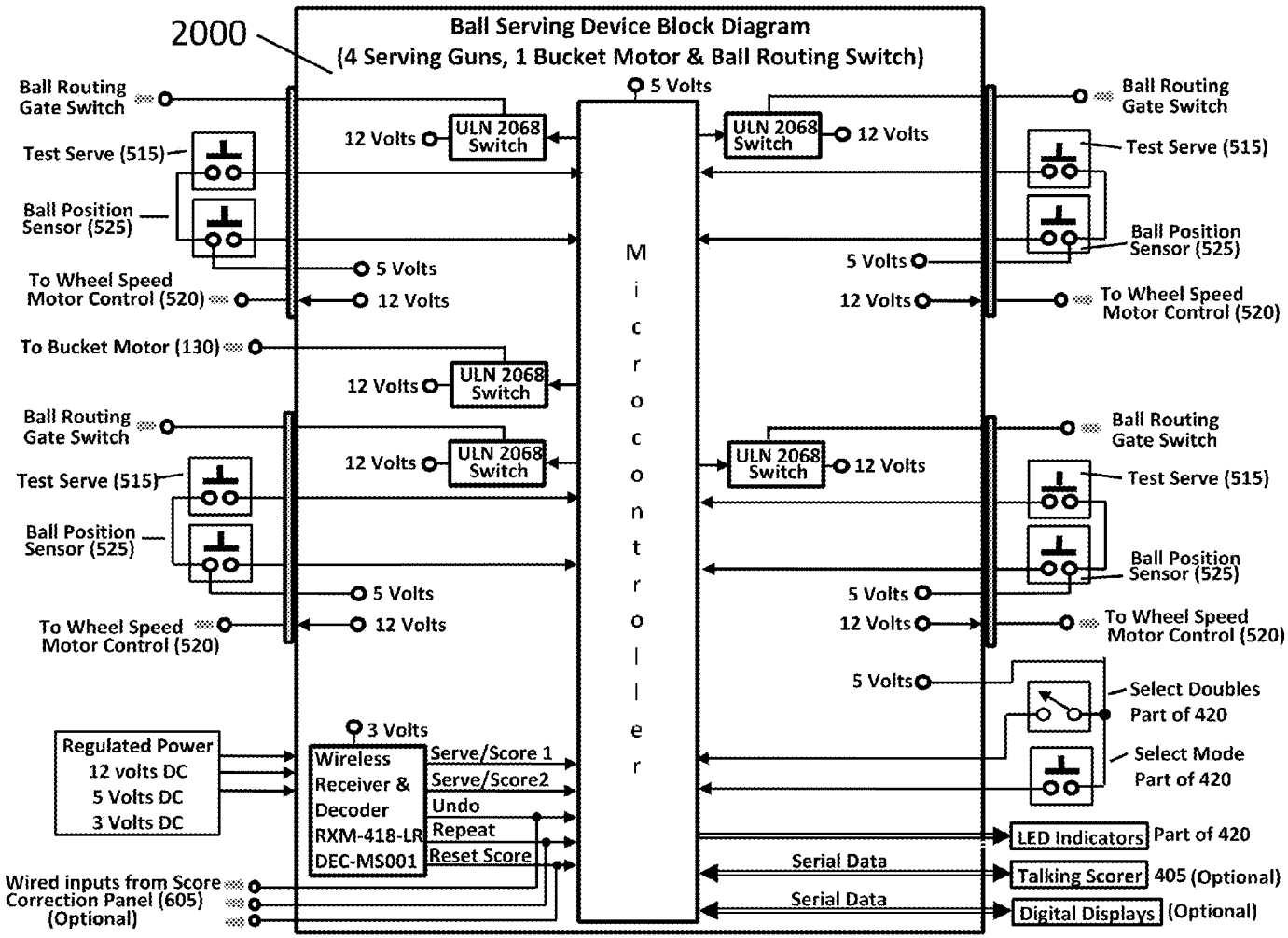
FIG. 20 is a diagram of an exemplary circuit that controls four serving guns, one bucket motor, and one ball routing switch mechanism.

FIGS. 1-3 show four motors 130, one motor 130 associated with each serving of the four serving guns. It will be recognized by those skilled in the art that the table 100 can be configured with various other combinations of motors 130 and serving guns. Various alternative configurations of the serving guns and the motors 130 are possible. FIGS. 13 and 14 illustrate a configuration in which two serving guns are fed by two motors 130. A diagram 1600 of an exemplary circuit for the two motor/two gun configuration is illustrated in FIG. 16. FIGS. 17-19 illustrate a configuration in which four serving guns are fed by one motor 130. A ball routing switch 1705 may be included in this configuration to properly route the balls to the correct serving guns. A diagram 2000 of an exemplary circuit for the one motor/four gun configuration is illustrated in FIG. 20.

Figure 15:
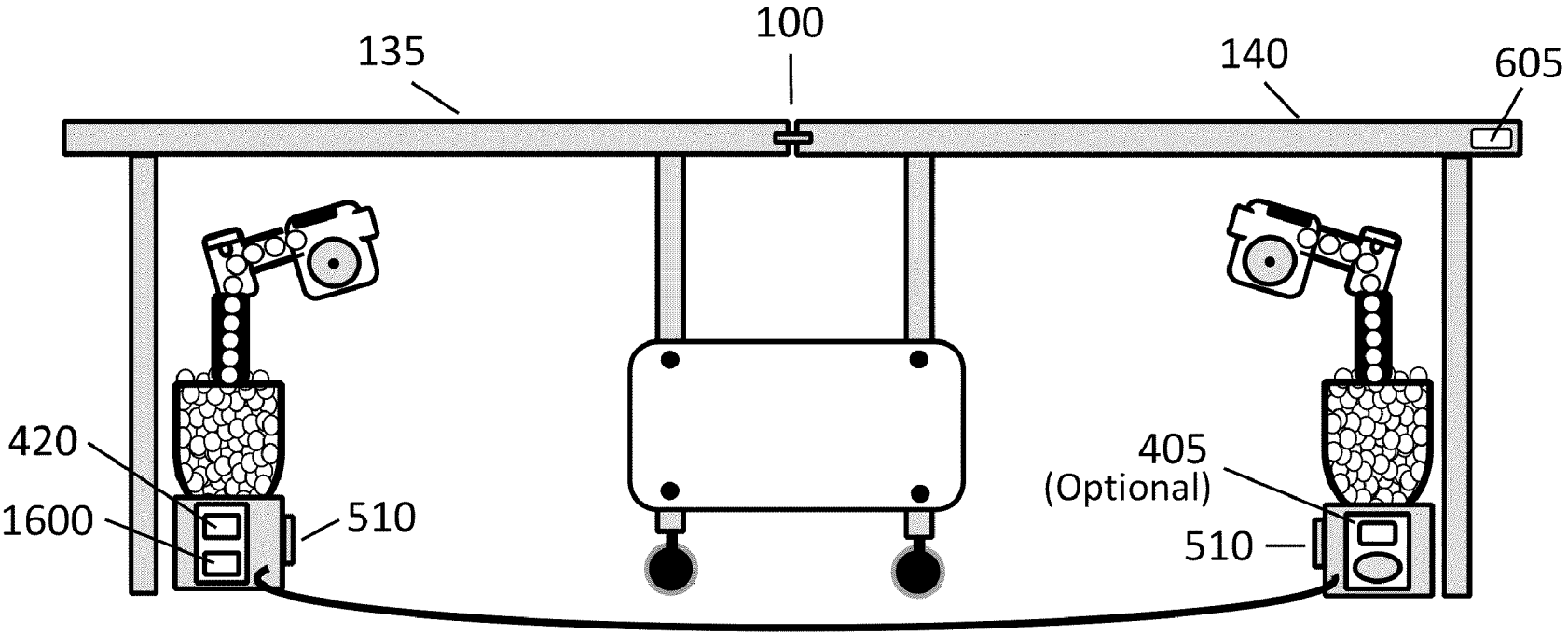
FIG. 15 is a side view of an exemplary ball serving device configured for use with an aftermarket table.

FIG. 15 shows a configuration in which the serving guns are not mounted on the table. It is envisioned that this embodiment may be used to add the serving guns to a standard table that was sold without the serving guns. The serving guns may be positioned on the floor under the table, and may be placed so that the serving guns serve the balls to proper serve receiving areas.

The serving guns, however configured, may be positioned to serve the ball to a specific section (i.e, a serve receive area)

of the table 100. The serving guns will typically serve the ball to the end opposite from the serving gun where there is a serve receive area. Referring again to FIG. 1, the serving gun 105 to the right of player one may serve to the same table side (i.e., left side of player two) at a first end 140 of the table 100. The serving gun 120 to the left of player one may serve to the right side of the first end 140 of the table 100. Similarly, serving gun 110 to the left of player two may serve to the right side of a second end 135 of the table 100, while the serving gun 115 to the right of player two may serve to the left side of the second end 135 of the table 100.

FIGS. 5-8 illustrate an exemplary embodiments of a ball serving system including a method of ball direction and propulsion from the serving guns. While it will be recognized by those skilled in the art that many types of propulsion and direction may be utilized for each serving gun, in various embodiments of the technology, the propulsion mechanism may be a rotating wheel 505.

Figure 45:
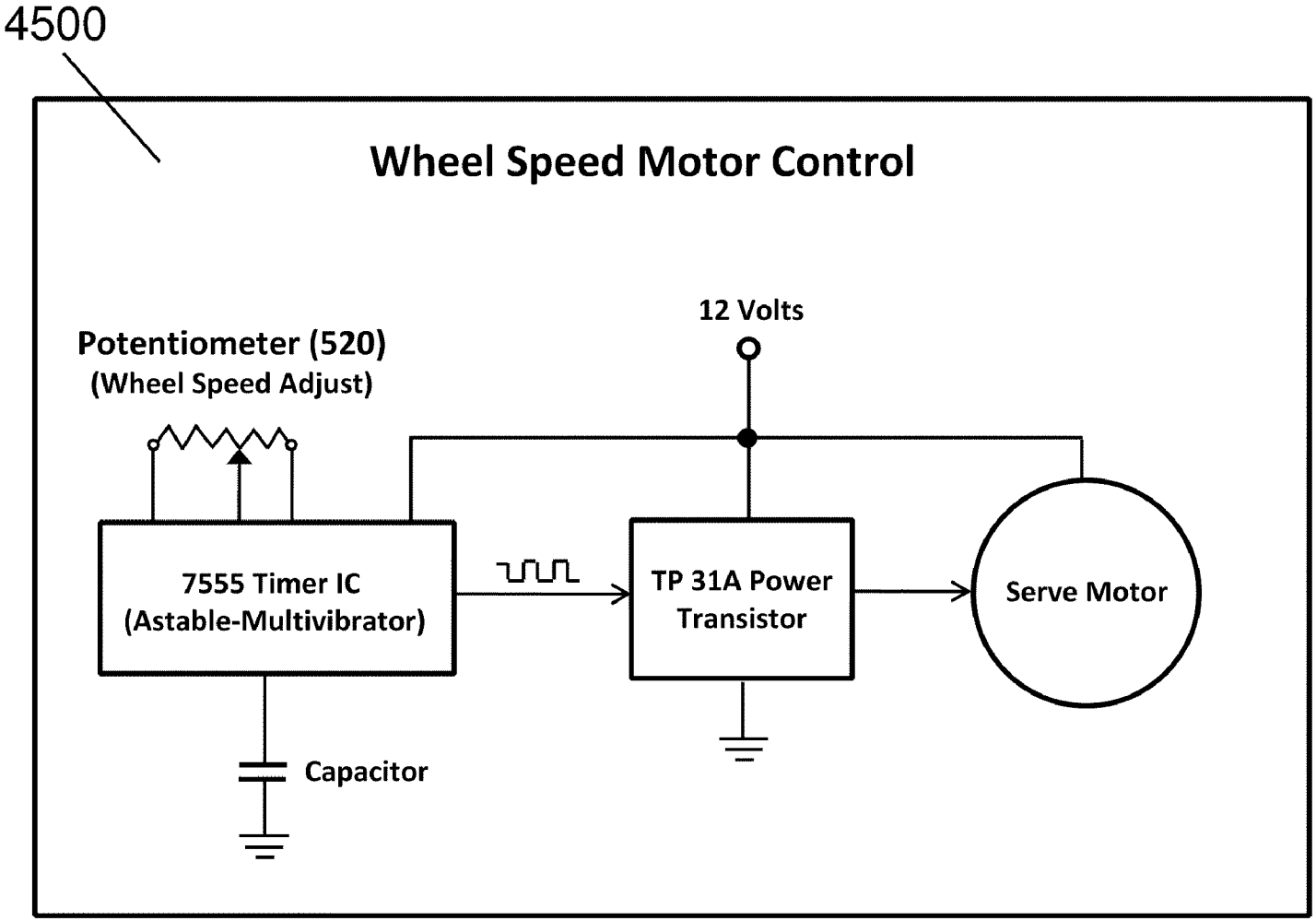
FIG. 45 is a diagram of an exemplary circuit for manual serving gun wheel speed motor control.

Each serving gun may be provided with a ball control panel 510 that controls the serving gun. The ball control panel 510 may include a test serve button 515 that allows the user to determine if the serving gun is properly set up. A wheel speed adjustment control 520 may also be provided to adjust the speed at which the balls are ejected from the serving gun. The ball control panel 510 and the wheel speed adjustment control 520 may be mounted on an edge of the table 100 as depicted in FIGS. 5-8. FIG. 45 is a diagram of an exemplary circuit 4500 that provides the ball serving system with manual control over the speed of the wheel 505.

A ball position sensor 525 may be installed in the serving gun 105 to determine the position of a given ball in the serving queue.

Figure 29:
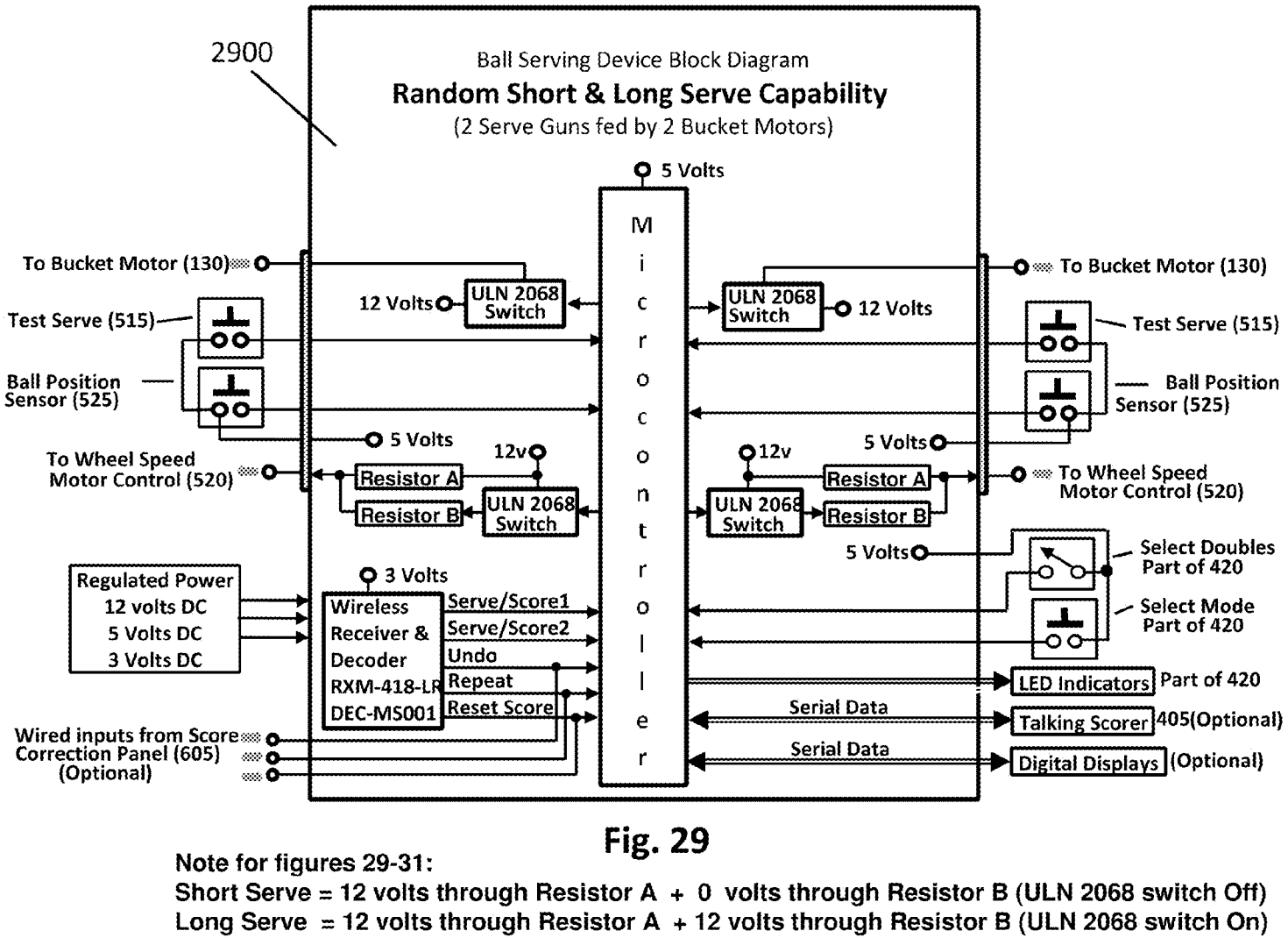
FIG. 29 is a diagram of an exemplary circuit to control a two gun/two bucket configuration with variable serve distance.
Figure 30:
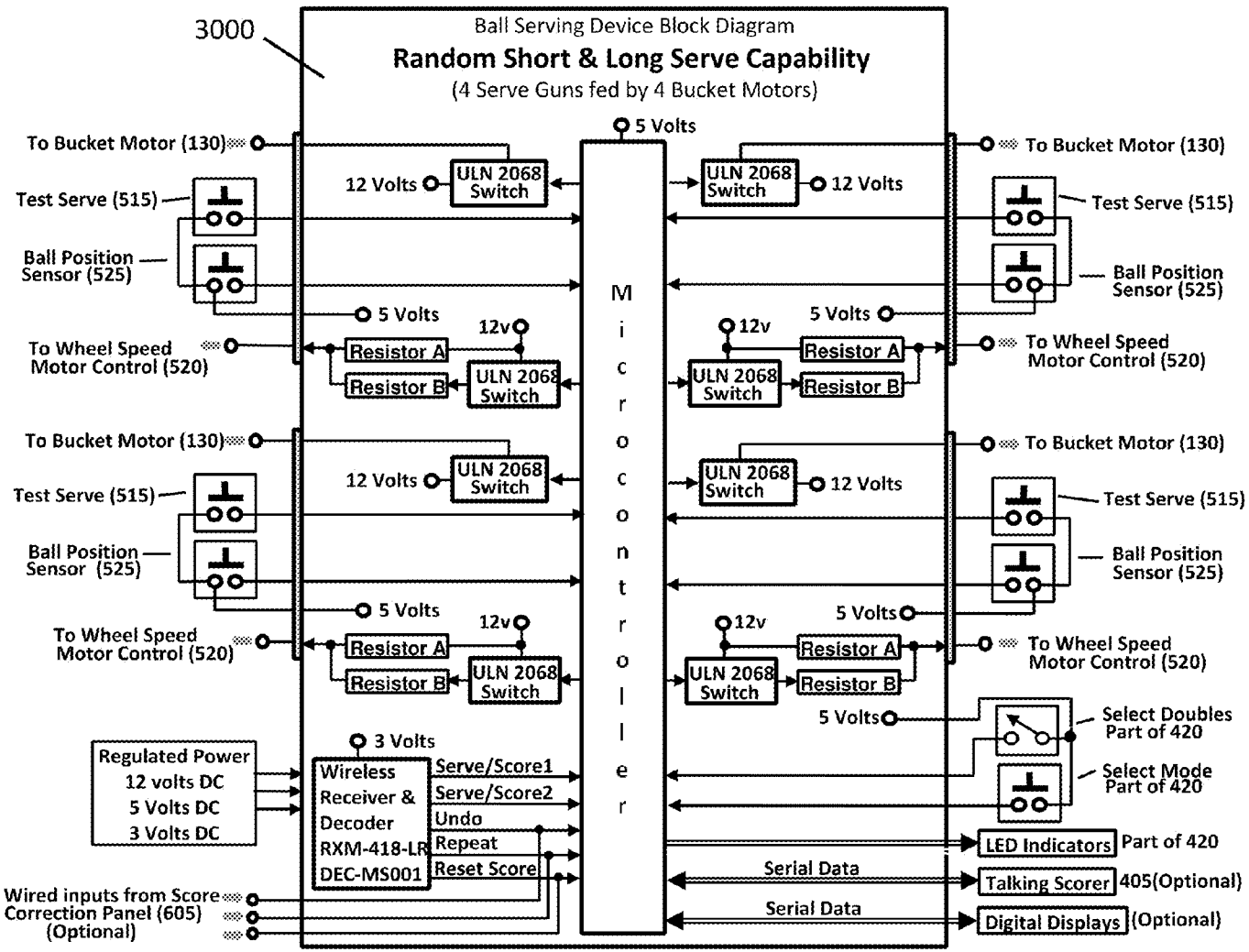
FIG. 30 is a diagram of an exemplary circuit to control a four gun/four bucket configuration with variable serve distance.
Figure 31:
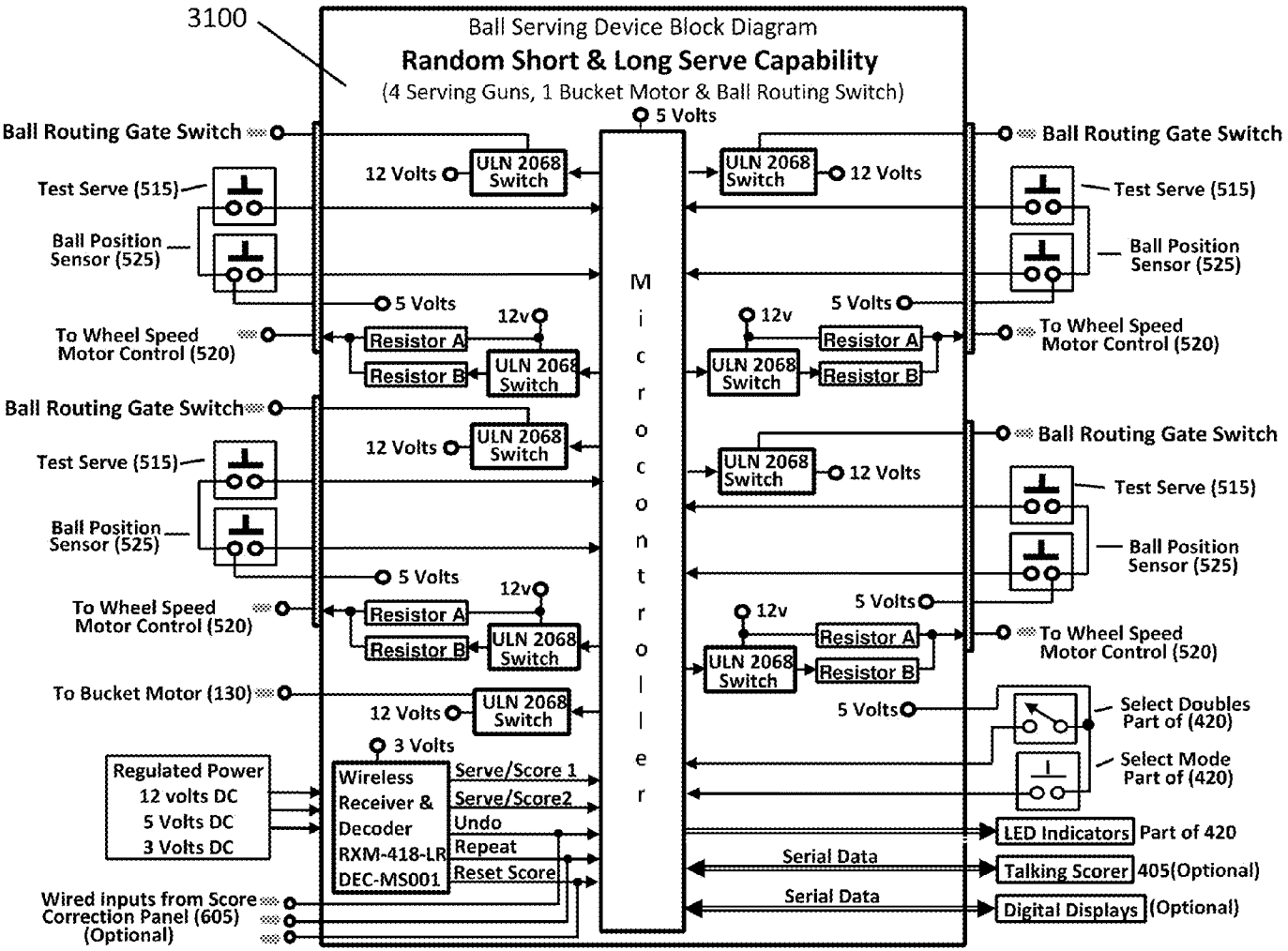
FIG. 31 is a diagram of an exemplary circuit to control a four gun/one bucket/ball router configuration with variable serve distance.

In some embodiments, the distance that the serving guns propel the ball on a serve may be varied. The ball serving system may be programmed to randomly select a distance each time a serve is triggered. Diagrams of exemplary circuits 2900, 3000, and 3100 that provide the serving guns with variable serving distance are illustrated in FIGS. 29-31. For a long serve (i.e., maximum distance), maximum power may be provided to the serving gun by enabling a power boost circuit that provides maximum power output through a second resistor B in parallel with the power from first resistor A. For a short ball-serve, the power boost circuit may be turned off and the serving gun may be powered using the single path power output through first resistor A.

When the ball serving system is used with the variable serving distance option, the ball serving distance may be manually calibrated during a first-time table set-up and power-on. To calibrate the short ball-serve, the serving gun may be triggered to fire balls while the user adjusts the wheel speed adjustment control 520 to provide enough power so that the ball consistently clears the net. It will typically not be necessary for manual adjustment of the long ball-serve function, as maximum power is simply applied to the serving gun.

Figure 32:
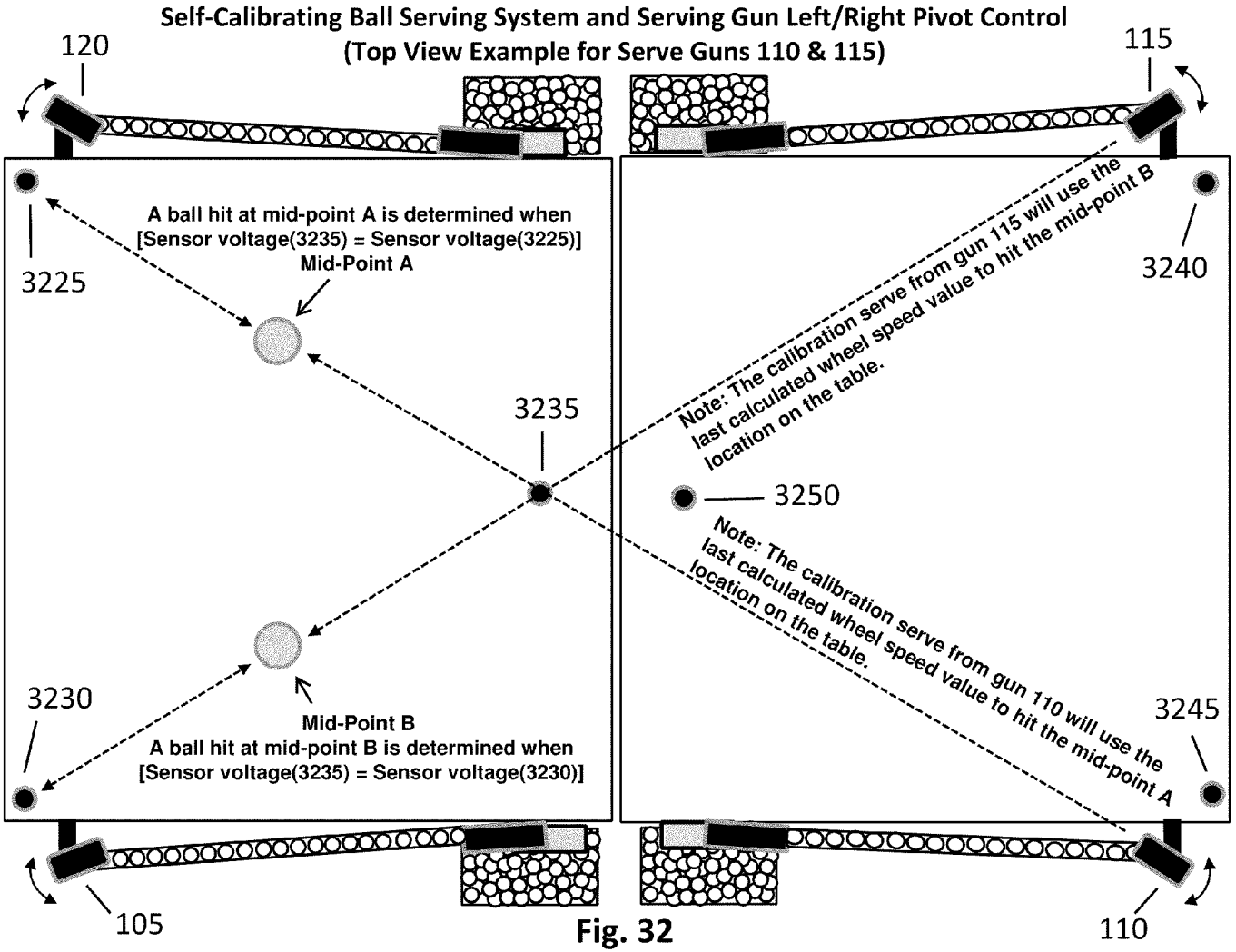
FIG. 32 shows a top view of an exemplary configuration for the self-calibrating ball serving system with pivot capability.
Figure 33:
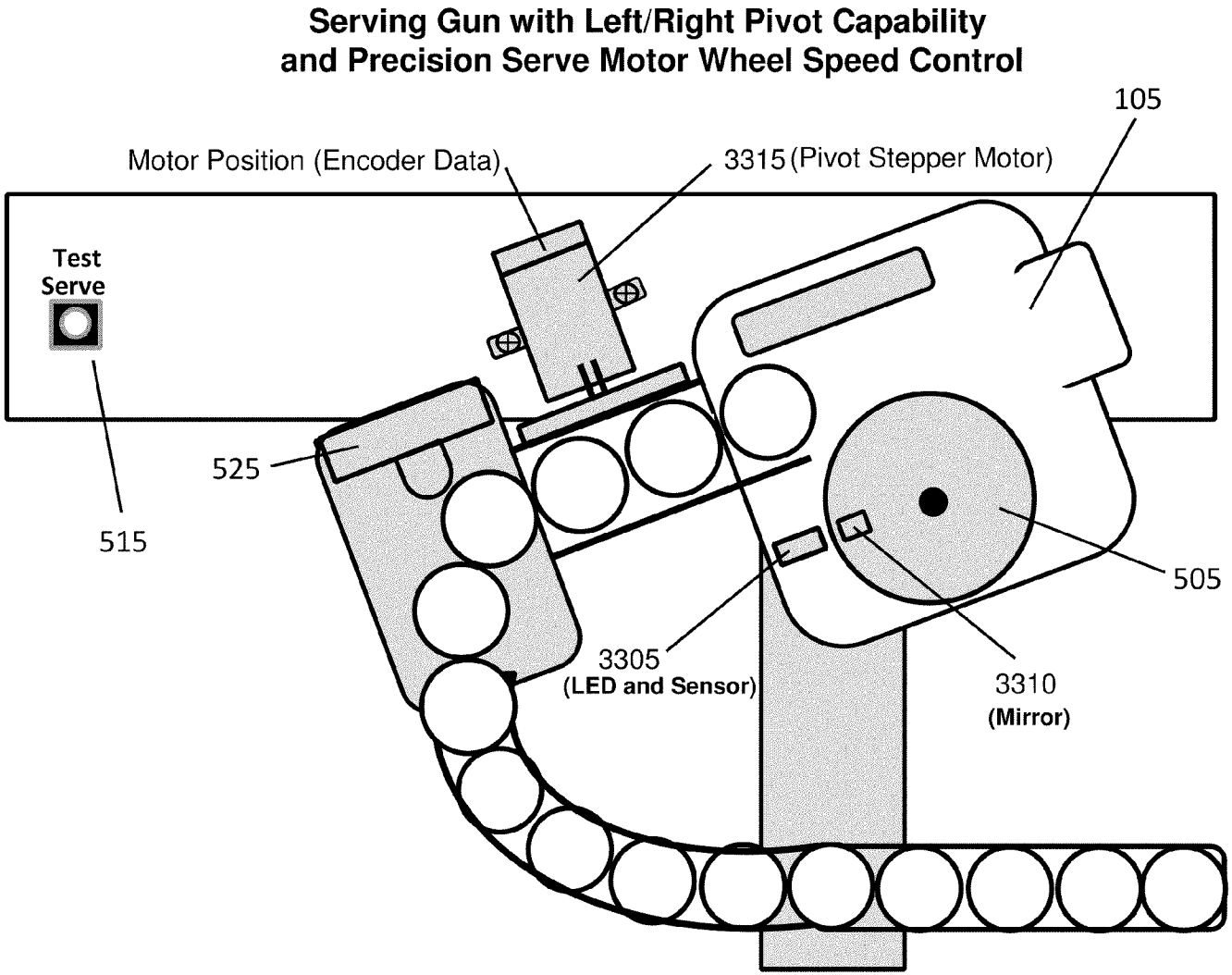
FIG. 33 is a detail view of a first serving gun with pivot capability.
Figure 34:
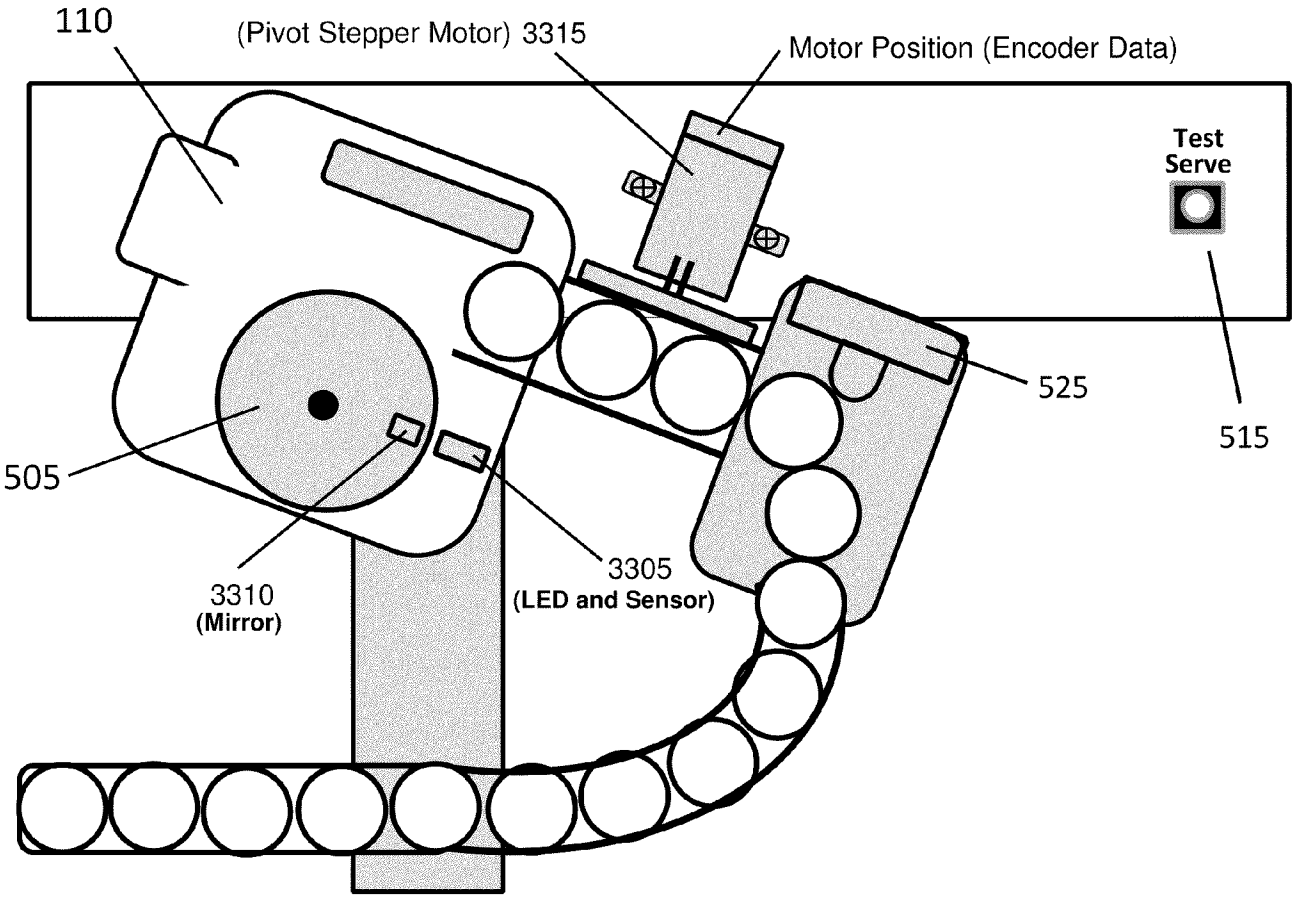
FIG. 34 is a detail view of a second serving gun with pivot capability.
Figure 35:
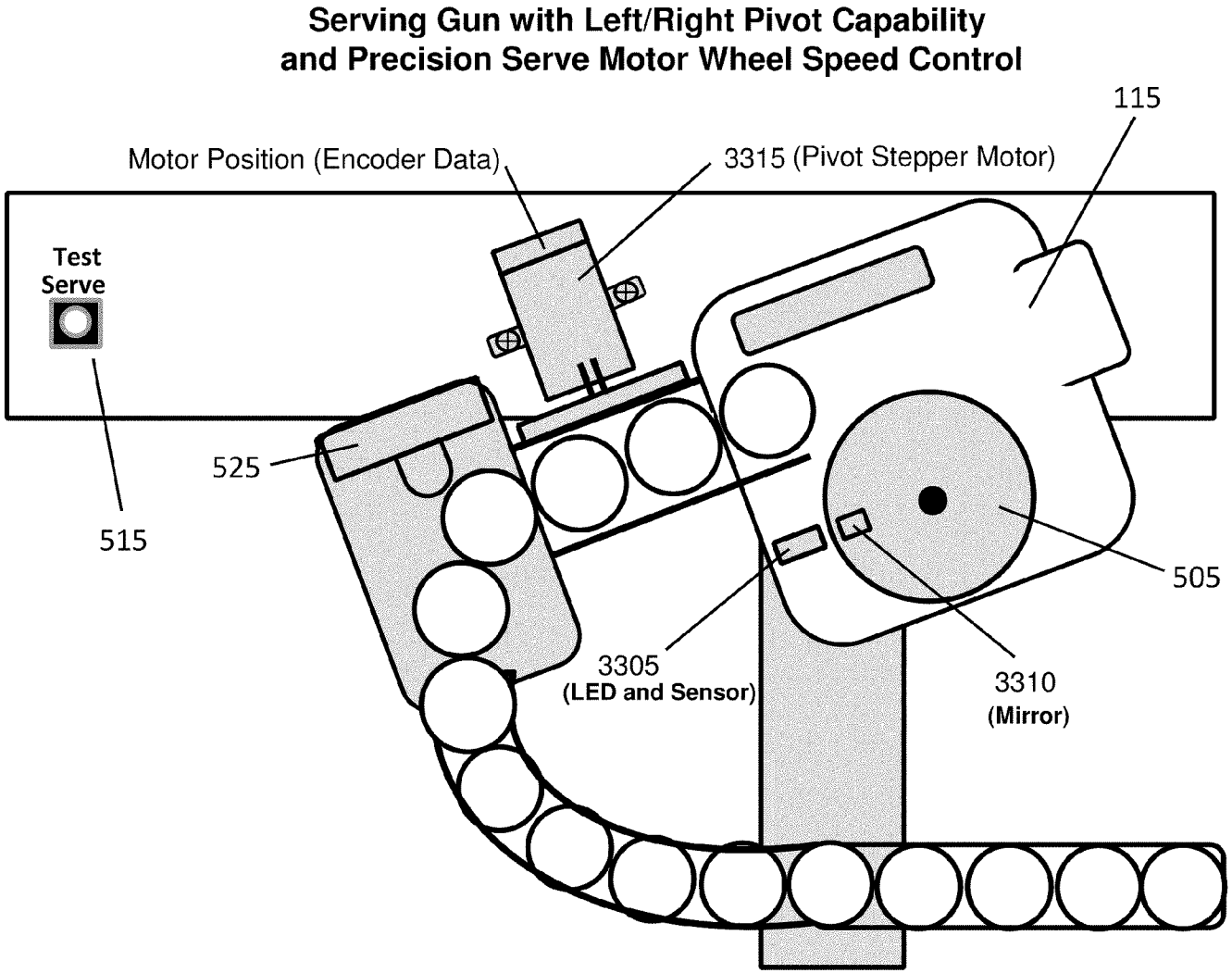
FIG. 35 is a detail view of a third serving gun with pivot capability.
Figure 36:
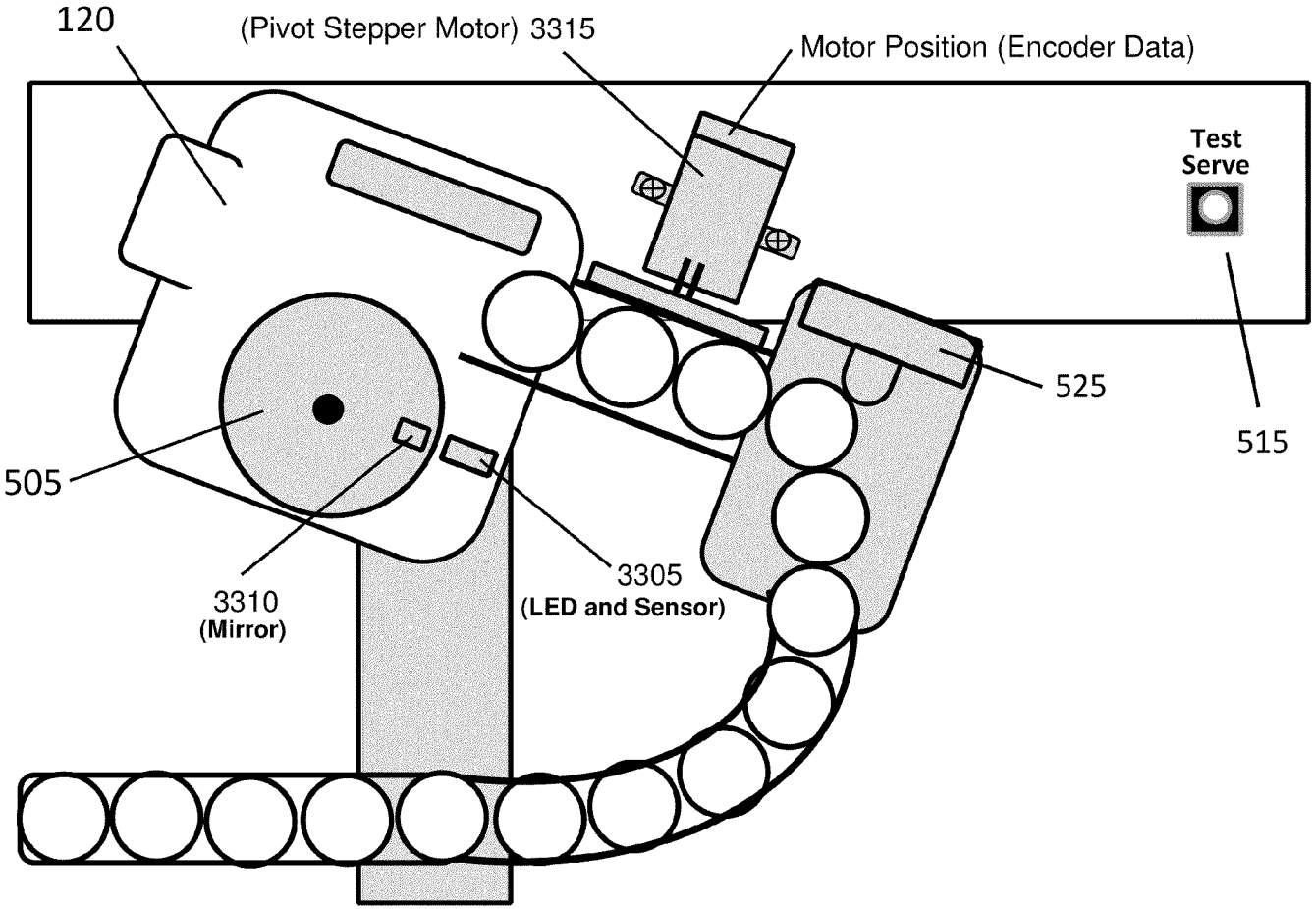
FIG. 36 is a detail view of a fourth serving gun with pivot capability.
Figure 37:
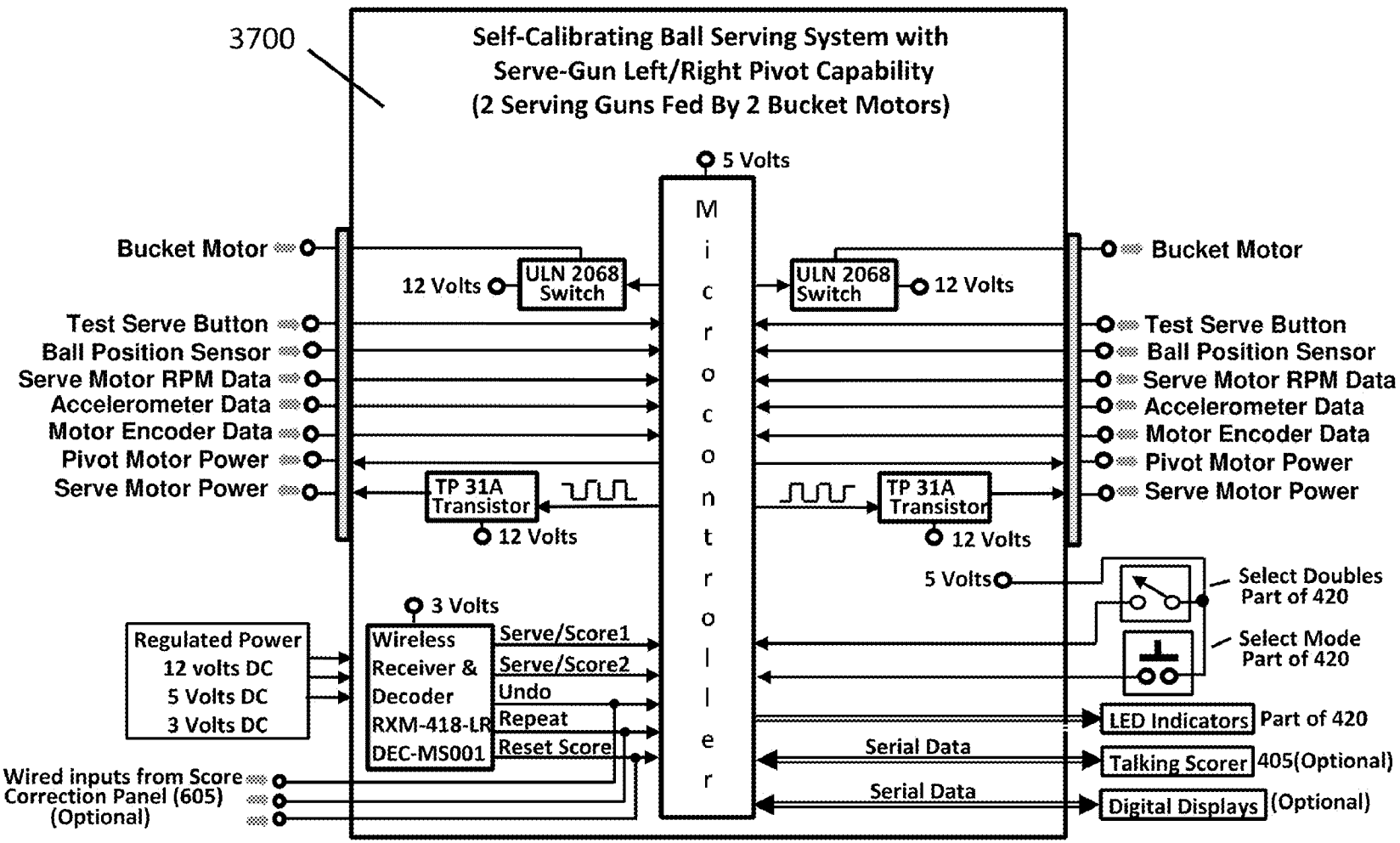
FIG. 37 is a diagram of an exemplary circuit for a self-calibrating ball serving system with a two serving guns/two bucket motors configuration.
Figure 38:
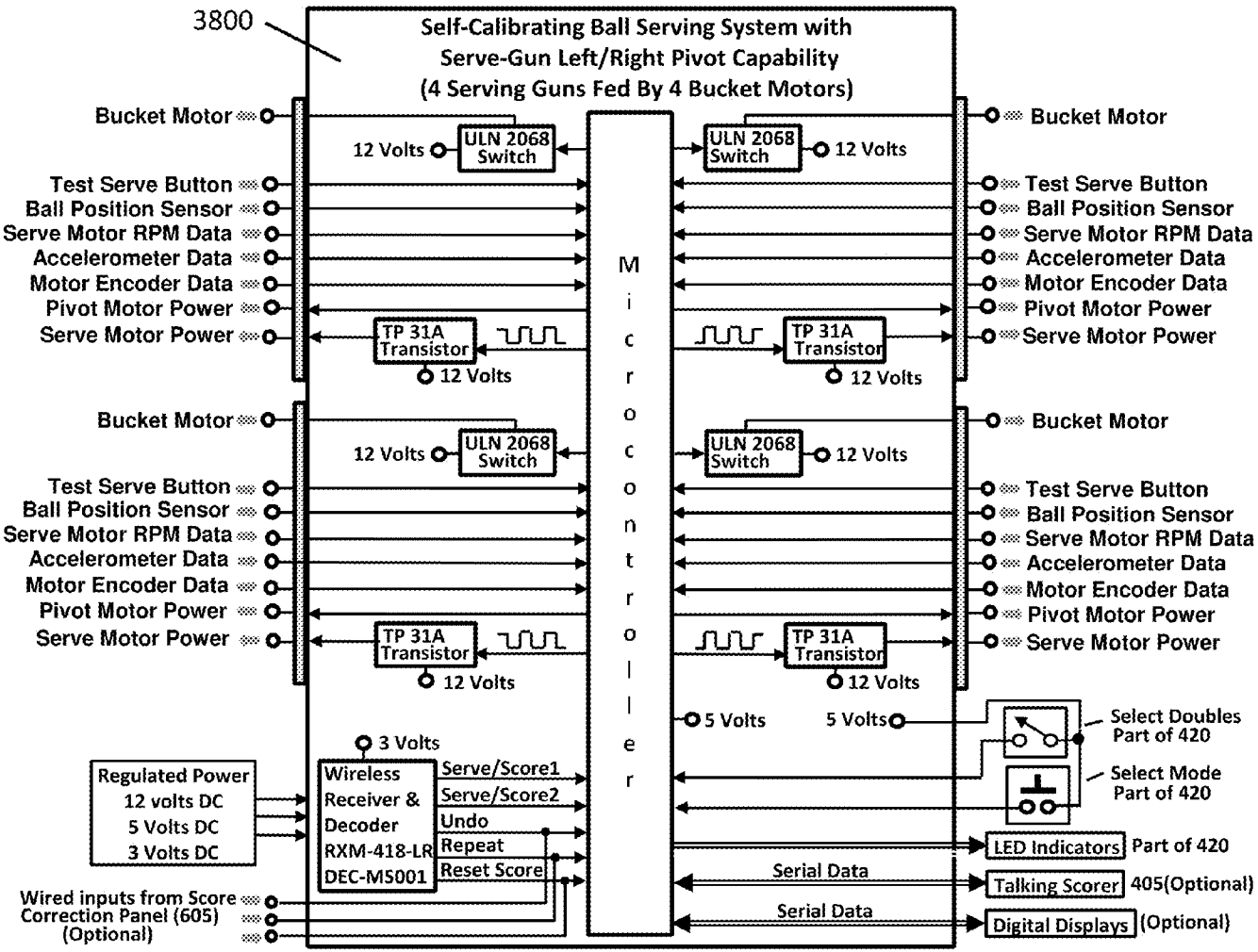
FIG. 38 is a diagram of an exemplary circuit for a self-calibrating ball serving system with a four serving guns/four bucket motors configuration.
Figure 39:
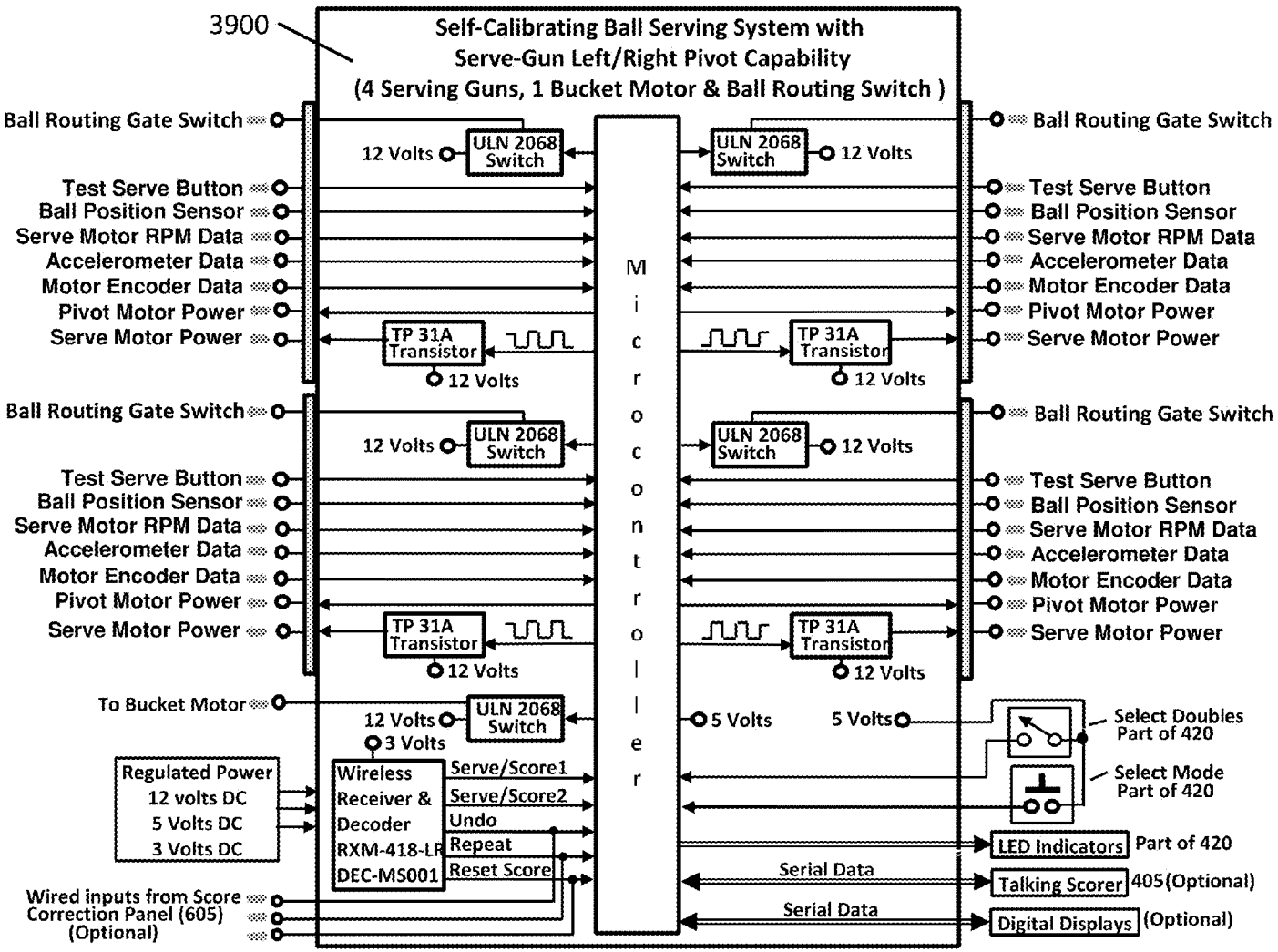
FIG. 39 is a diagram of an exemplary circuit for a self-calibrating ball serving system with a four serving guns/one bucket motor/one ball routing switch mechanism configuration.

In other embodiments of the ball serving system, the system may be self-calibrating. The self-calibrating system may use sensors to determine a landing position of the ball. Accelerometers may be used as the sensing devices. An exemplary configuration illustrated in FIG. 32 utilizes six accelerometers 3225-3250 and four serving guns 105-120. Diagrams of exemplary circuits 3700, 3800, and 3900 that operate the self-calibrating method of distance control for various configurations of the system are illustrated in FIGS. 37-39.

Calibration of the ball serving system may be initiated by triggering one of the serving guns (e.g., serving gun 115) to serve a ball. When the ball contacts the table 100, two voltages may be read from accelerometers 3230 and 3235. The accelerometer voltage data may be used to determine where the ball hit on the table. For illustrative purposes, the voltage from accelerometer 3230 is designated as V3230, and the voltage from accelerometer 3235 is designated as V3235. If V3230−V3235=0, then the ball hit at mid-point B. If V3235−V3230>0, then the ball landed short of mid-point B. If V3235−V3230<0, then the ball landed past mid-point B. The difference between the accelerometer voltages may be used to calculate the desired serving gun wheel speed RPM value based on the calibration serve.

Figure 40:
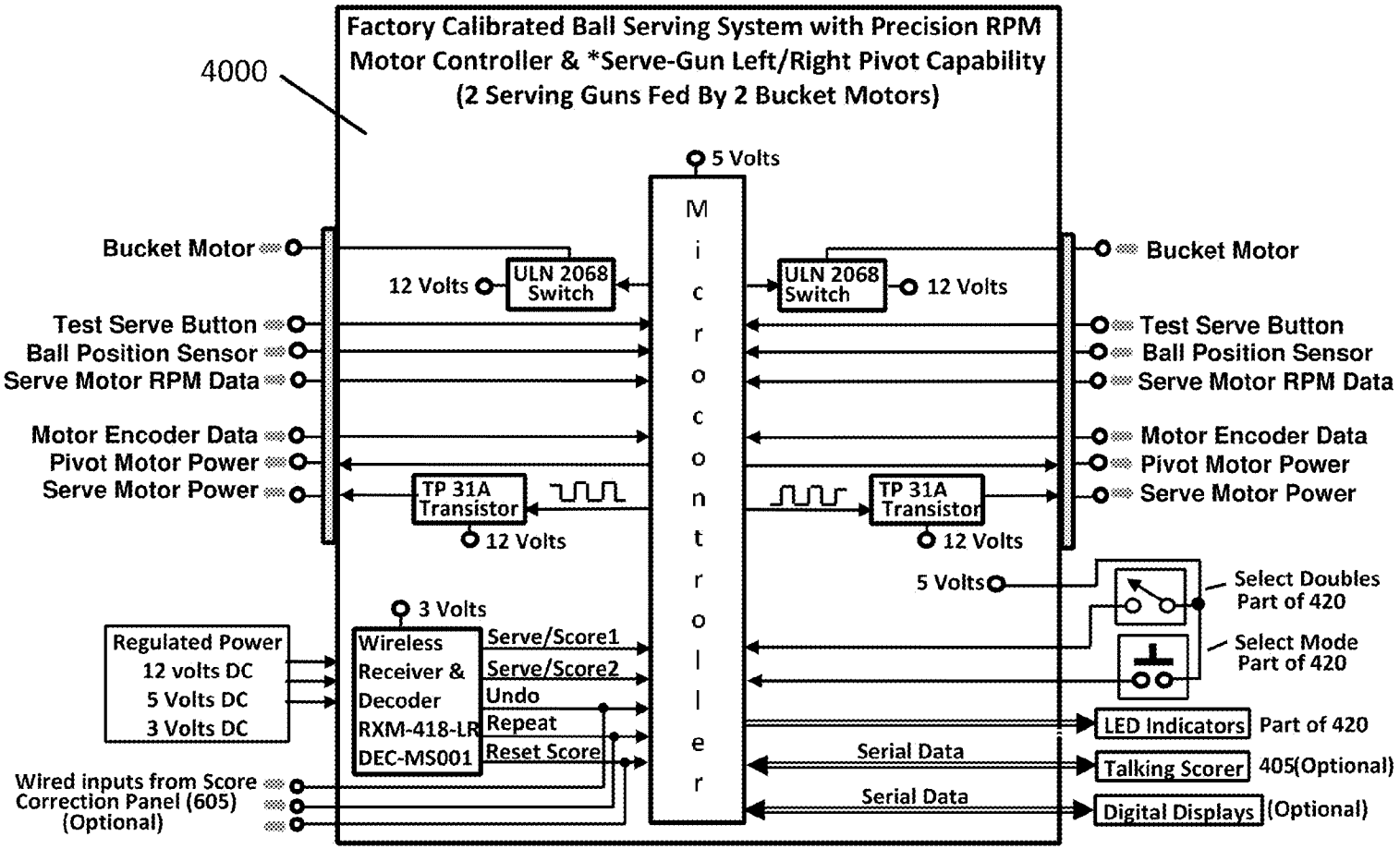
FIG. 40 is a diagram of an exemplary circuit for a ball serving system with an RPM motor controller in a two serving guns/two bucket motors configuration.
Figure 41:
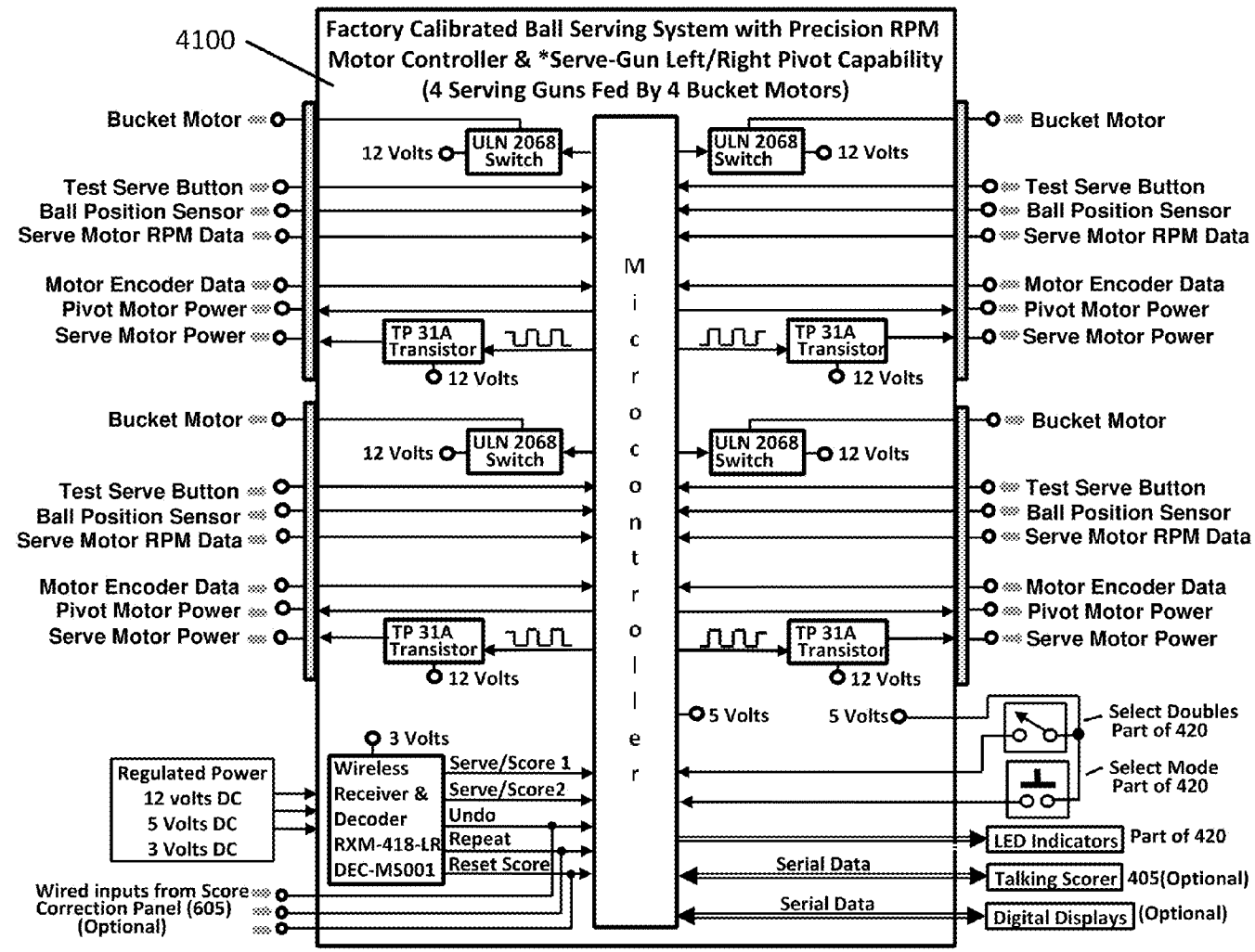
FIG. 41 is a diagram of an exemplary circuit for a ball serving system with an RPM motor controller in a four serving guns/four bucket motors configuration.
Figure 42:
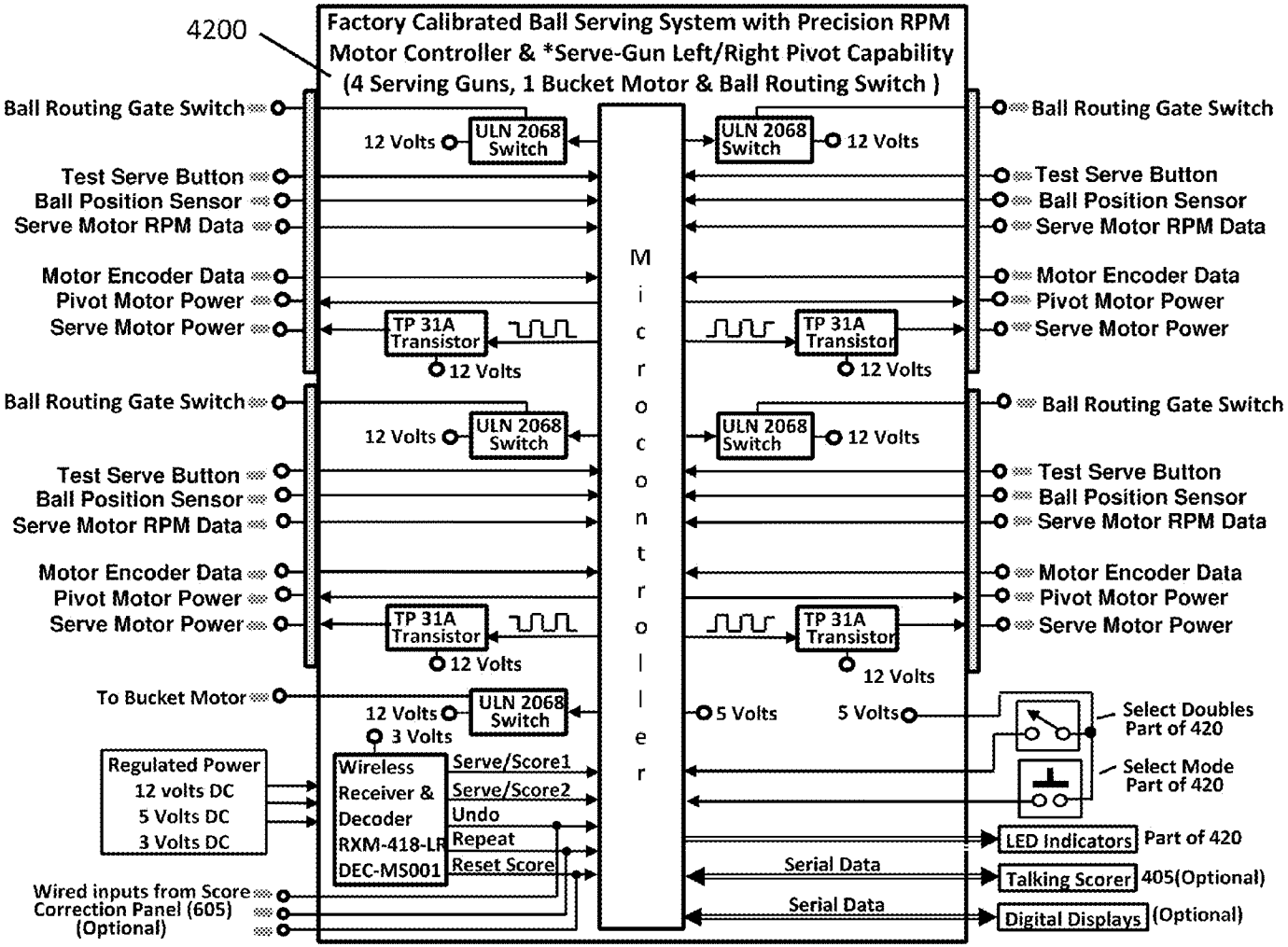
FIG. 42 is a diagram of an exemplary circuit for a ball serving system with an RPM motor controller in a four serving guns/one bucket motor/one ball routing switch mechanism configuration.

An alternative configuration utilized in various embodiments to allow variable ball serve distance is illustrated in FIGS. 33-36. Diagrams of exemplary circuits 4000, 4100, and 4200 that operate this alternative method of distance control for various configurations of the system are illustrated in FIGS. 40-42. In this configuration, an LED and sensor unit (e.g., phototransistor 3305) may be used to monitor the RPM of the wheel 505. The RPM is determined by the phototransistor 3305 detecting a reflection from a mirror 3310 affixed to the wheel 505 of the serving gun. The RPM of the wheel 505 may be varied according to the data obtained from the phototransistor 3305. If the RPM drops below a preset low limit, power to the wheel 505 may be increased, thereby increasing the RPM. Conversely, if the RPM increases above a preset high limit, power to the wheel 505 is decreased. Using the digital RPM data from the phototransistor 3305 allows the ball serving system to compensate for aging components so that the system may retain accurate ball serve velocity throughout its lifetime. Those skilled in the art will recognize that many different systems of monitoring and varying the RPM of the wheel 505 may be utilized.

Another variation used in various embodiments of the ball serving system includes a configuration in which the serving guns 105 may be rotated to change the direction of the serve. In this configuration, illustrated in FIGS. 33-36, the serving guns 105 are rotatably mounted on the table 100. A pivot stepper motor 3315 may be used to rotate the serving gun, thereby altering the direction of the ball served. Operation of the ball serving system with rotating serving gun capability may be controlled by the circuits 3700, 3800, and 3900 illustrated in FIGS. 37-39. In order to ensure proper serving distance, the ball serving system adjusts the RPM of the wheel 505 according to the direction in which the serving gun is directed. The calibration serve RPM value may serve as the baseline value used to calculate the required wheel RPM for different serve receive locations on the table. Each serve gun position (based on encoder data from the stepper motor) may have an associated predefined constant that is added or subtracted from the calibration serve RPM baseline value.

Figure 4:
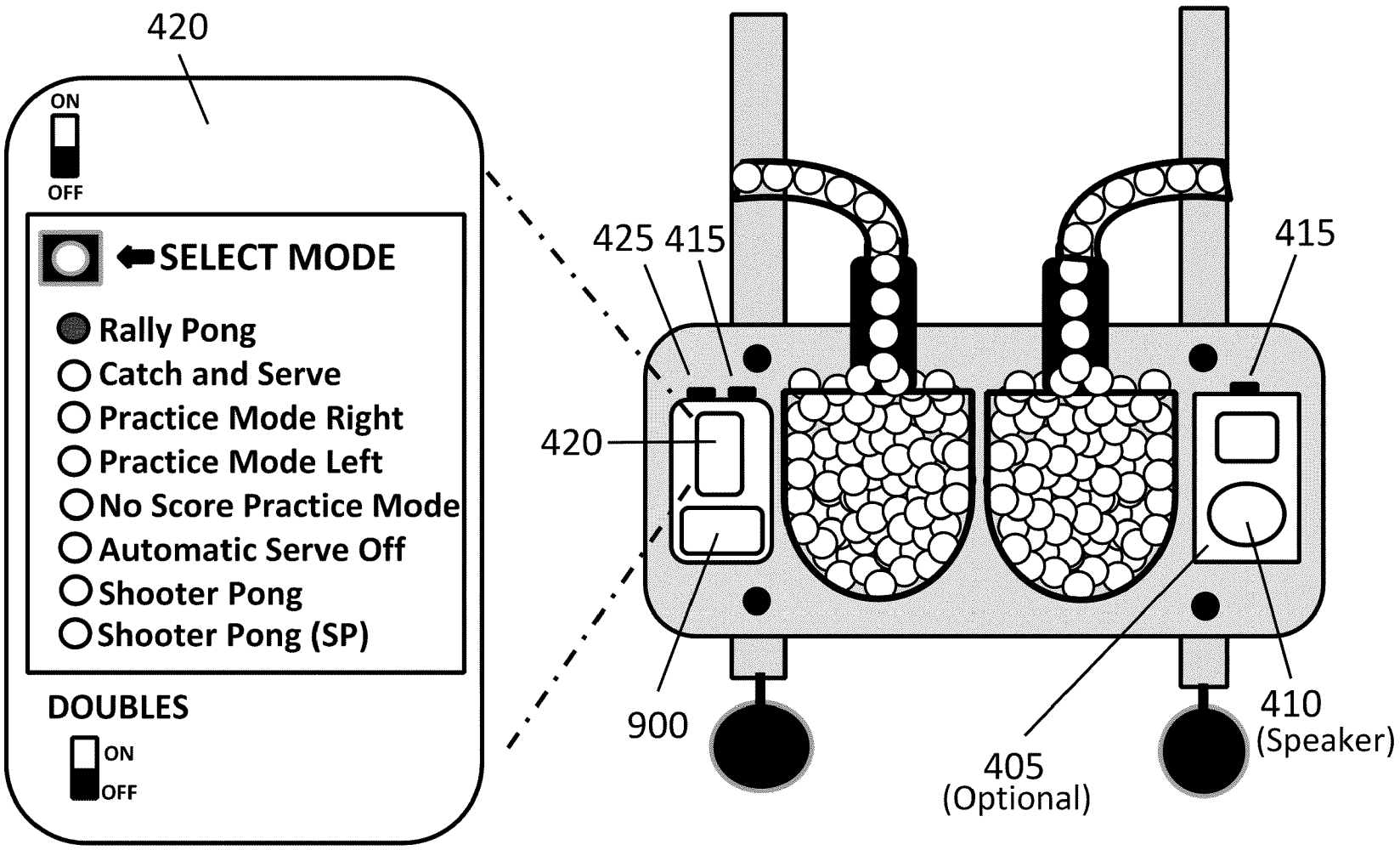
FIG. 4 is a detail view of the ball serving device control and display panel of the table of FIG. 1.
Figure 5:
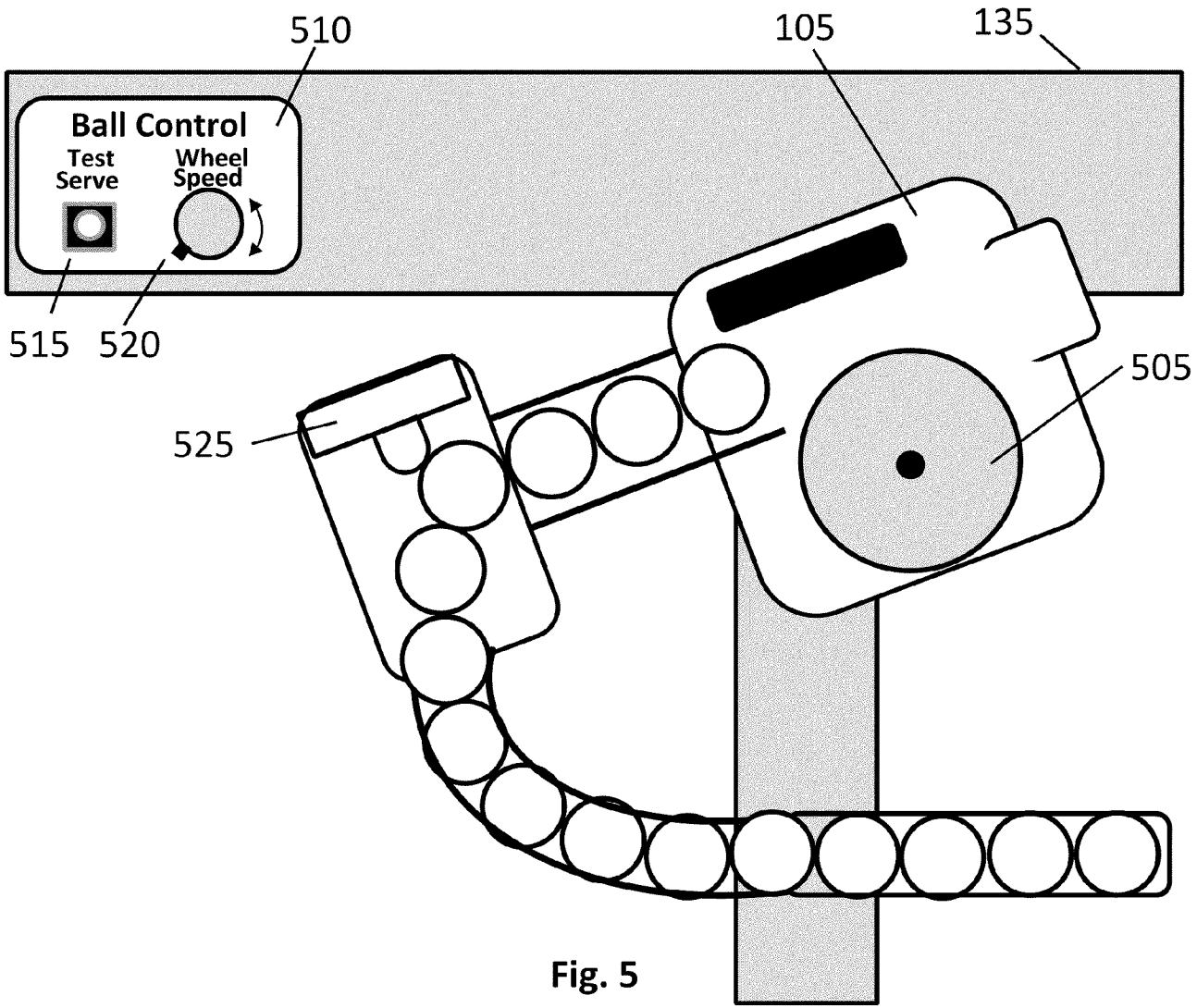
FIG. 5 is a detail view of a first serving gun and the ball control panel of the table of FIG. 1.

Referring now to FIG. 4, the serving guns can typically be used in conjunction with an automated scoring device 405. The automated scoring device 405 may include a speaker 410 so that the automated scoring device 405 may have the capability to audibly announce the score and game situation (e.g., server, change serve). In order to synchronize the operation of the serving guns and the automated scoring device 405, a system link 415 may be provided. The system link 415 couples the automated scoring device 405 to a user interface and display panel 420 that controls the operation of the serving guns, thereby establishing the control system for the automatic ball serving system. (Options available through the user interface and display panel 420 are described in further detail below.) If the user has chosen to include the digital display option of the automated scoring device 405, a digital display jack 425 is provided to connect the automated scoring device 405 to a digital display for a visual display of the score.

Figure 6:
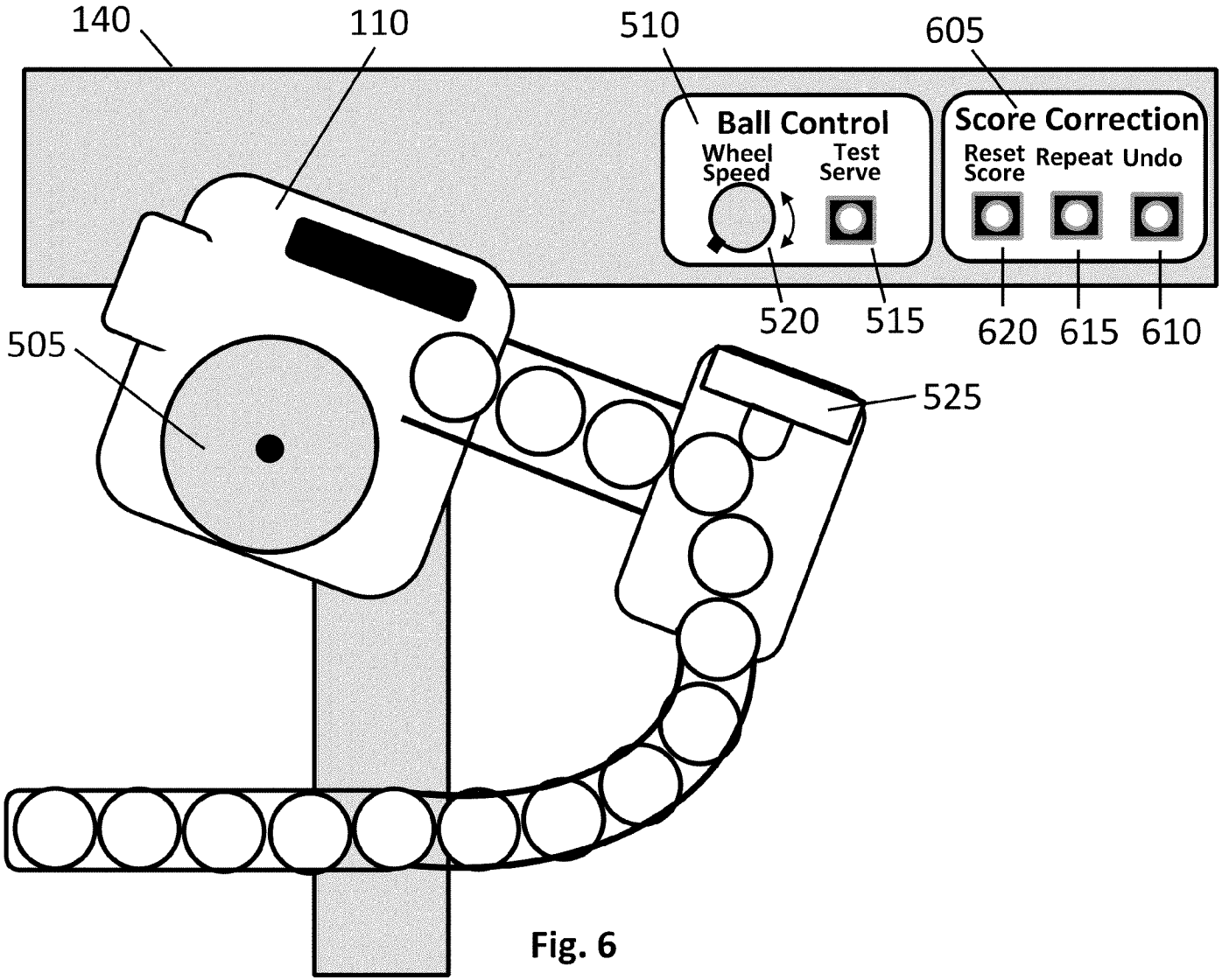
FIG. 6 is a detail view of a second serving gun, the score correction panel and the ball control panel of the table of FIG. 1.
Figure 7:
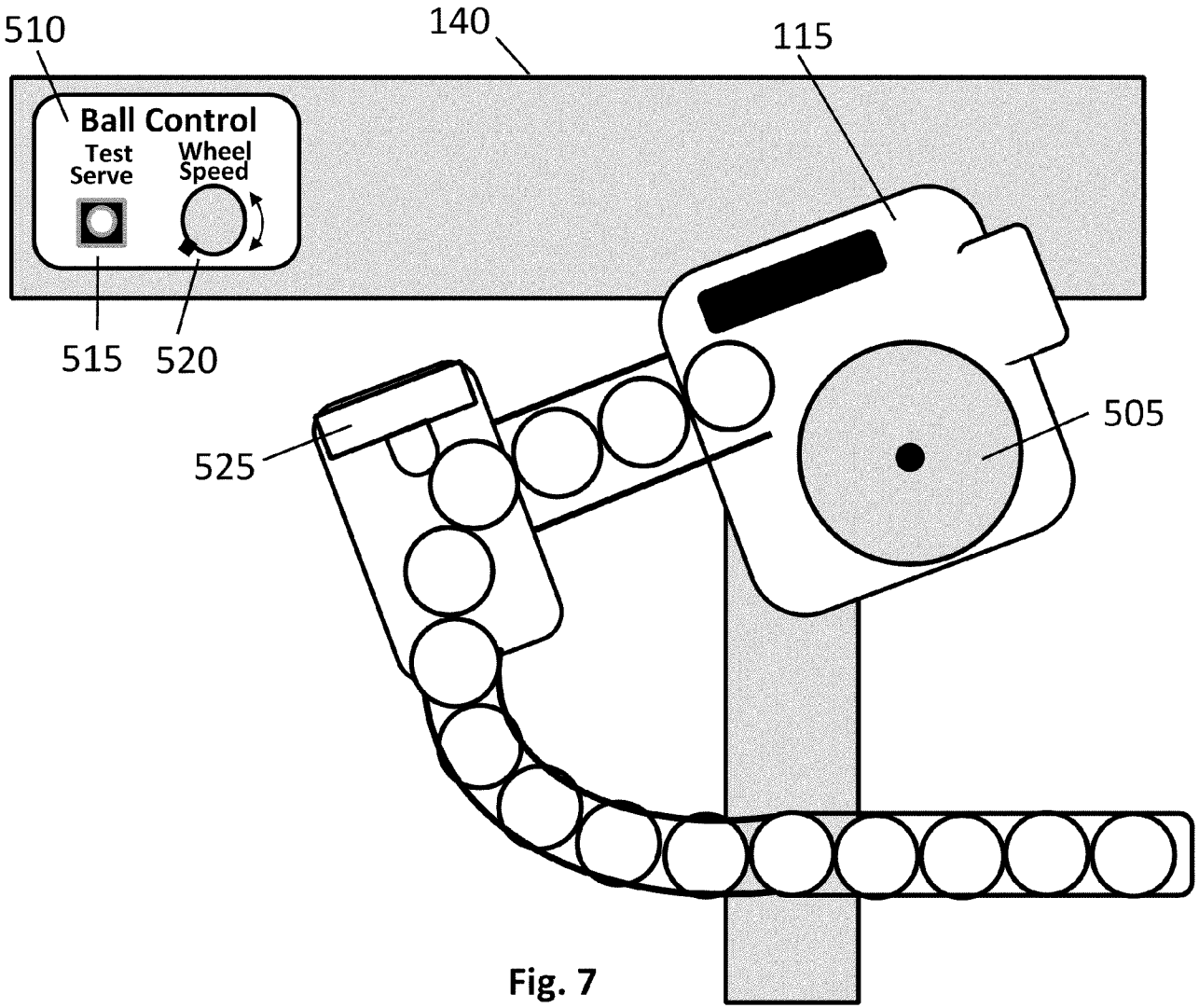
FIG. 7 is a detail view of a third serving gun and the ball control panel of the table of FIG. 1.
Figure 8:
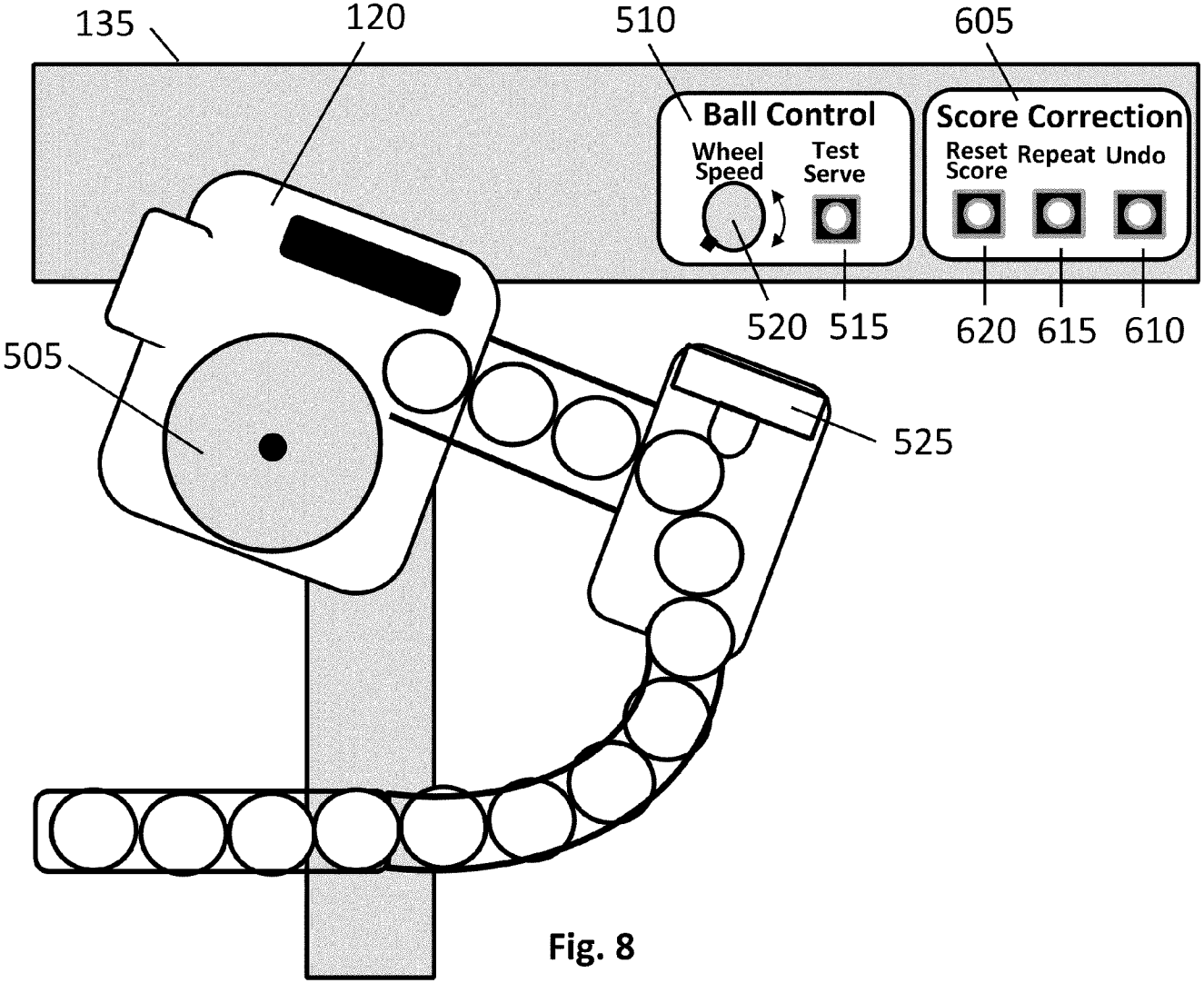
FIG. 8 is a detail view of a fourth serving gun, the ball control panel, and the score correction panel of the table of FIG. 1.
Figure 12:
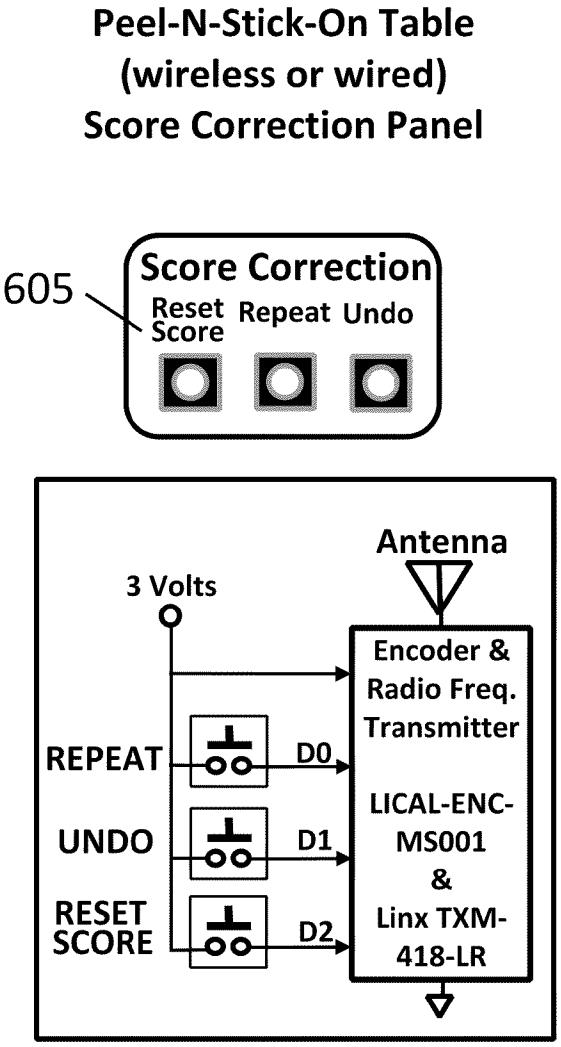
FIG. 12 illustrates an exemplary configuration for the score correction panel (wireless or wired) and a diagram of an exemplary circuit used for the wireless remote score correction panel

As is illustrated in FIGS. 6, 8, and 12 (wiring diagram), a score correction control panel 605 may be provided to manually control the automated scoring device 405. At least one score correction control panel 605 may be mounted on each end 135, 140 of the table 100. The score correction control panel 605 may include an undo button 610 that erases the last point entered. The score correction control panel 605 may also include a reset score button 620. The reset score button 620 may reset the score, for example, to 0-0 at the start of a new game.

At times, it may be desirable to fold the table 100 for storage. When this is the case, a connector joint 1710 may be included in each of the straight feed tubes 210. The connector joint 1710 may also be positioned between the straight feed tubes 210 and the elbow tubes 205. The connector joint 1710 may be employed at any position which facilitates folding of the ball feed tubes 205, 210 in order to fold and store the table 100.

The operation of the automated scoring device 405 is described in detail in the related U.S. Pat. No. 6,270,431, issued Aug. 7, 2001. In various embodiments, the automated scoring device 405 and the serving guns are coupled to establish the ball serving control system. The ball serving system outputs data to the automated scoring device 405 to track the score so that the automated scoring device 405 is able to audibly notify the players of the score.

Figure 11:
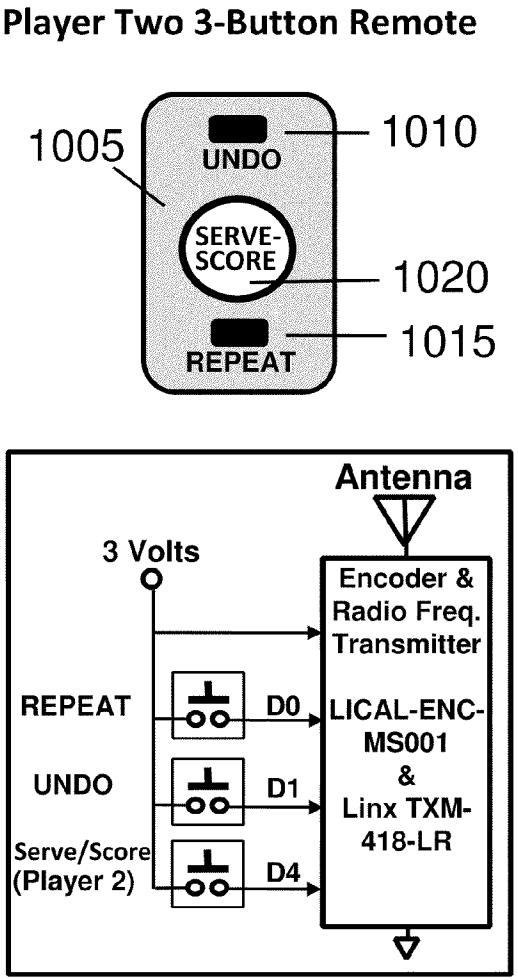
FIG. 11 illustrates an exemplary configuration for the 3-button wireless remote used by player two and a diagram of an exemplary circuit used for the player two 3-button wireless remote.
Figure 10:
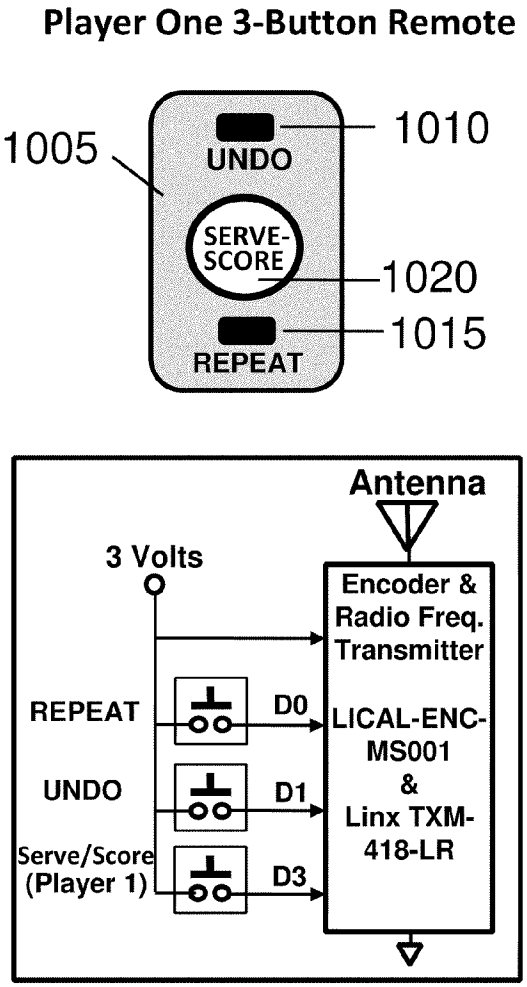
FIG. 10 illustrates an exemplary configuration for a 3-button wireless remote used by player one and a diagram of an exemplary circuit for the player one 3-button wireless remote.

The automated scoring device 405 may require an input of which player wins each point to accurately track game progress. One method of providing such input is illustrated in FIGS. 10 and 11, each of which includes a three button wireless device 1005 that can communicate with the ball serving system, display panel's 420 user interface/display, and scoring device 405. The three button device 1005 may include an undo button 1010 that, similar to the table mounted score correction control panel 605, allows a user to erase the last result input to the automated scoring device 405. The three button wireless device 1005 may also include a repeat button 1015 which allows the user to have the automated scoring device 405 repeat the current score.

One function of the three button wireless device 1005 is incrementing the score as points are completed. Whenever a user wins a point, the user may press a serve/score button 1020. Depressing the serve/score button 1020 causes the ball serving system to increment the score of the proper player and to track the number of points played. In various configurations, pressing the serve/score button 1020 may cause one or more of the serving guns to eject a ball.

Figure 21:
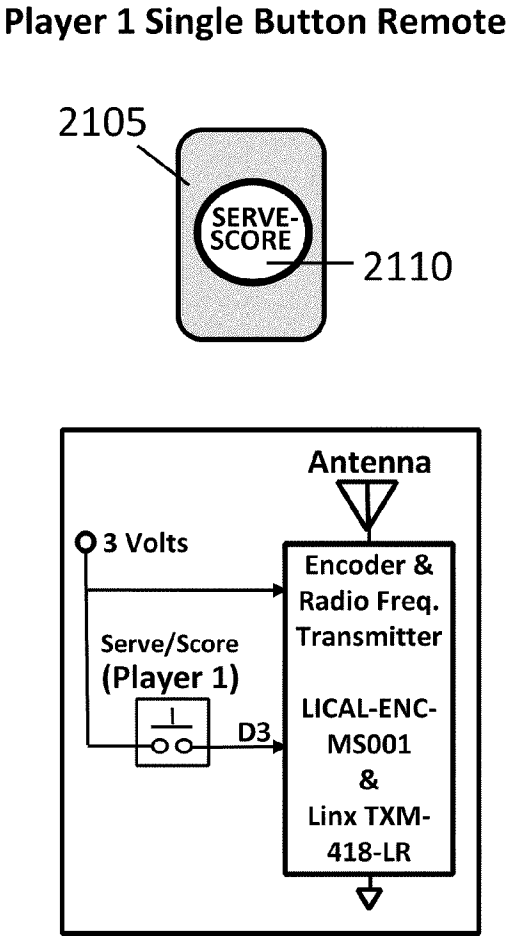
FIG. 21 illustrates an exemplary configuration for a single-button wireless remote used by player one and a diagram of an exemplary circuit used for the player one single-button wireless remote.
Figure 22:
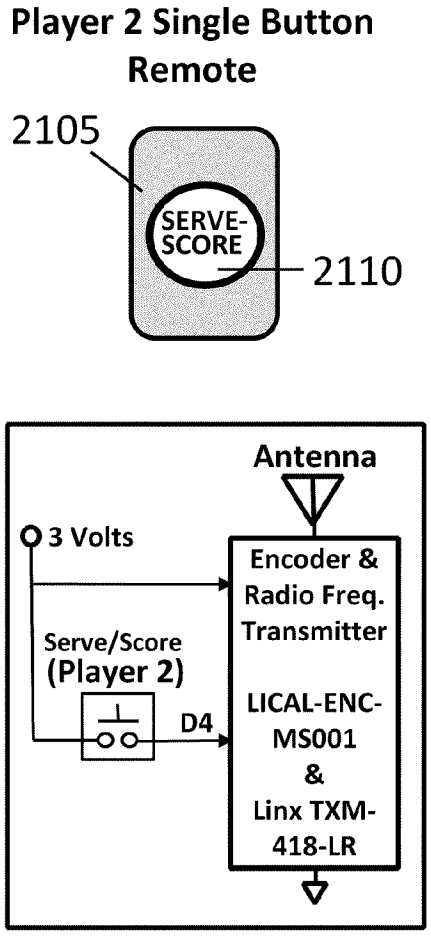
FIG. 22 illustrates an exemplary configuration for a single-button wireless remote used by player two and a diagram of an exemplary circuit used for the player two single-button wireless remote.

Another version of the wireless device is the one button wireless device 2105 illustrated in FIGS. 21 and 22. The one button wireless device 2105 has only a serve/score button 2110. The function of the serve/score button 2110 is the same as that of the serve/score button 1020 on the three button wireless device 1005.

Another wireless device that may be used to operate the ball serving system is illustrated in FIGS. 43 and 44. A table tennis paddle 4305 may include a serve/score button 4310. In various embodiments, the serve/score button 4310 is located at the base of the handle of the paddle 4305. A user may activate the serve/score button 4310 by tapping the paddle 4305 against his hip or thigh, on the table 100, or on any other available resistive surface.

The table tennis game with an automated ball serving gun and automated scoring device 405 may be programmed to provide at least eight selectable play options. The options are shown in the detail view of the user interface and display panel 420 illustrated in FIG. 4.

A first selectable option may be a "Rally Pong" mode. With this option, the remote devices 1005, 2105, and 4305 and serving guns are used to start each point. A ball is served by the serving gun directly to a receiving player after a serve/score button is pressed. Unlike traditional table tennis, no time is wasted waiting for a server to retrieve and serve the ball. Typically, a ball is served in less than two seconds after a player actuates his serve/score button.

Players may score their own points using wireless remote control devices 1005, 2105, and 4305. Typically, the players try to score their points as quickly as possible in an attempt to catch their opponent off balance or out of position. The "Rally Pong" game is so fast that mentally keeping track of the serve-turn and score would be extremely difficult. The serve-turn problem may be solved by the ball serving system. The score keeping problem may be solved by the automated scoring device 405, which announces the score after a ball is put into play.

In the "Rally Pong" mode, a new game may be initiated by selecting power on or by pressing a reset score button 620. Either of these actions can reset the ball serving guns and output the "Reset Score" message from the automated scoring device 405. The players may assume their playing positions and prepare for the first serve of the next game. At this point, the serving guns and the automated scoring device 405 may be waiting for a first remote serve/score button input from either player. After the first serve/score button input is received, the message "Begin New Game" is announced through the automated scoring device 405 and the display panel's 420 user interface randomly selects the first serving player. The ball is served to the receiving player immediately after the "Begin New Game" message is announced.

The automated scoring device 405 may also announce a midpoint of a game. According to the rules of the game of table tennis, at the midpoint of a game that is a rubber game, the players switch ends. If the game being played is not a rubber game, then the midpoint signal may be ignored by the players.

The table may be equipped with two serving guns, with one serving gun mounted on each side of the table (FIGS. 13, 14, and 15). According to various embodiments of the invention, the table may be equipped with four serving guns. In the four gun configuration, a pair of serving guns is directed towards each end of the table (FIGS. 1-3, 17, 18, and 19). With the four serving gun option, the display panel's 420 user interface may randomly select left or right serve receiving area, with the display panel's 420 user interface then activating the appropriate serving gun for the chosen receiving area.

Still referring to FIG. 4, the second selectable game option is the "Catch and Serve Mode." This mode accommodates players who prefer to serve the ball themselves. In this mode, the serving gun can softly eject a ball to the serving player to catch-and-serve. This game may be slower than the "Rally Pong" option, but may still be faster than traditional table tennis because the server is not wasting time retrieving the ball between rallies. The score is announced by the automated scoring device 405 immediately after the ball is ejected to the serving player.

The third and fourth selectable options are single player practice modes, namely, "Practice Mode Left" and "Practice Mode Right," respectively. A player may select an automatic continuous ball serving mode from either end of the table 100. After the mode is selected, the player has a preset time (such as five seconds) to prepare before the serving guns begin serving. The serving guns continue to serve balls at a preset rate until the serving guns run out of balls or until the device is switched off by the player. If four serving guns are installed, the serve may alternate between left and right side serving guns.

The fifth selectable option shown in FIG. 4 is the "No Score Practice Mode" where two players (for singles) or four players (for doubles) may practice without the interruption caused by the score announcing system. In this mode, the score announcements and attendant ball serve delays may be suppressed. Specifically, there may be no ball serve delay for the "Begin New Game", "Skunk", "Reset Score", "Deuce" and "Game Over" messages. However, there may be a ball serve delay for the change of serve direction where the ball is served after the "Rotate Serve" message. This mode of play may be even faster than "Rally Pong" mode. Players can practice against each other at a very fast rate continuously until the ball serving gun runs out of balls.

A sixth selectable option shown in FIG. 4 is the "Automatic Serve Off" mode where the serving players retrieve and serve the ball themselves. The automated scoring device feature may be used in this mode. This mode may be used, for example, if the serving machine is broken or not enough balls are available to utilize the serving machine function.

Figure 23:
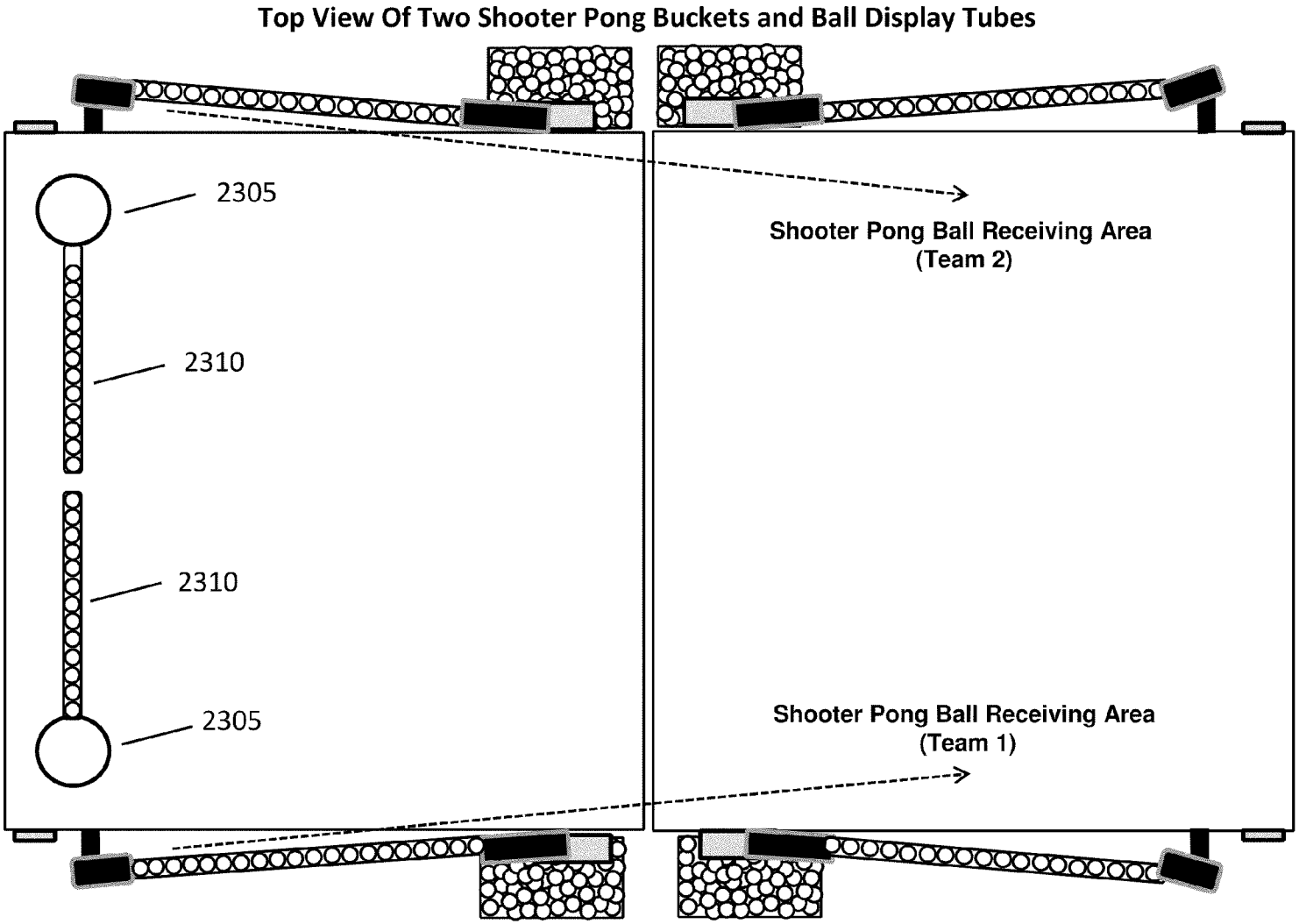
FIG. 23 illustrates a top view of a table with two "Shooter Pong" buckets.
Figure 24:
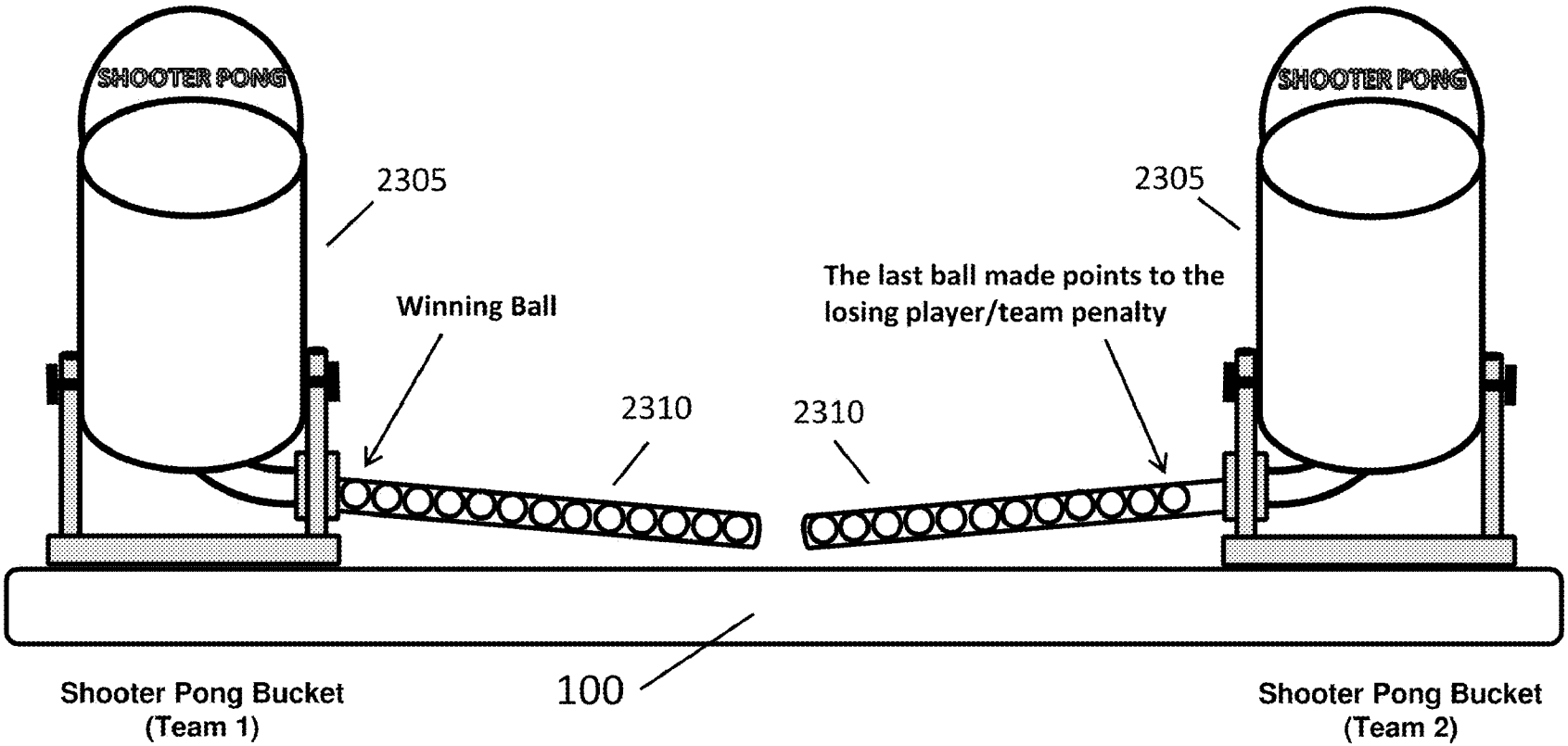
FIG. 24 is an end view of the table illustrated in FIG. 23.
Figure 25:
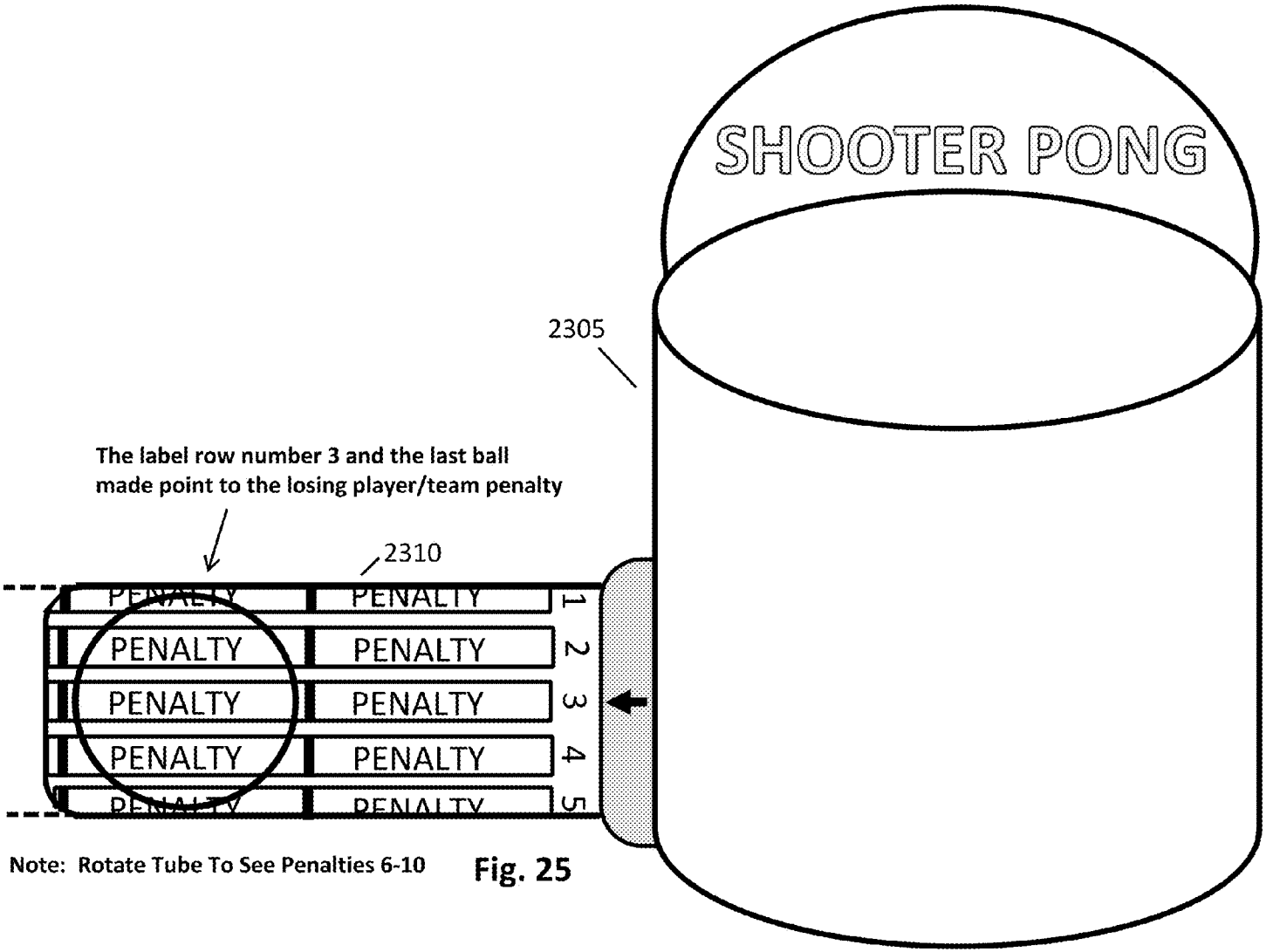
FIG. 25 shows a detail view of the "Shooter Pong" bucket and numbered penalty marker rows (one through five) and arrow pointer

FIG. 4 shows a seventh selectable option, the "Shooter Pong" mode. In "Shooter Pong" mode, two serving guns from one end of the table 100 may alternate serving balls to the left and right side receiving areas at the second end 135 of the table 100. As depicted in FIGS. 23 and 24, two buckets 2305 may be positioned as targets at the table end opposite the players.

The object of the "Shooter Pong" game is for player 1 (or team 1) and player 2 (or team 2) to hit their balls into their designated target bucket 2305. Balls that are hit into the target buckets 2305 may be funneled into a clear tube 2310 that may be rotatably attached to the bottom of the target bucket 2305. The clear tube 2310 can display the number of balls made (i.e., hit into target bucket 2305) by the respective players or teams. A sensor in the clear tube 2310 may be used to detect when clear tube 2310 has been filled. The player/team that fills their clear tube 2310 first wins the game. The losing player/team may be subject to a penalty that may be found on a label affixed to the clear tube 2310.

As depicted in FIGS. 25 thru 28, the penalty labels may be listed between two border lines that are spaced apart to match the width of each ball. The last ball made, which appears under the tube label, is the losing team/player's penalty. To provide a greater variety of penalties and a more random selection of penalties, the ball tube may provide ten rows of penalties that are repeated in random order. To obtain a penalty, a player may simply rotate the ball tube (illustrated in FIG. 25) until the penalty number (which may be randomly chosen by the ball serving system) aligns with an arrow marker at the point where the ball tube connects to the ball bucket. In addition to the example ball tube labels shown in FIGS. 26 thru 28, the players can design and/or order additional ball tube labels.

In "Shooter Pong" mode, after the serving guns serve a given number of balls (e.g., twenty balls), the ball serving system may cause the serving guns to momentarily stop serving and signal the automated scoring device 405 to output a series of beep tones and/or announce "Next Player". If teams are playing, then player two may play the next twenty balls for his team. The "Shooter Pong" mode lends itself to certain social events as there is no limit to the number of players on a team, and it is not necessary for the teams to have the same number of players. The players on each team may rotate after each set of twenty balls served.

In "Shooter Pong" mode, after the clear tube 2310 is filled, the target bucket 2305 may output a signal to the ball serving system to turn off the serving guns and signal the automated scoring device 405 to announce or display the results of the game. For example, the announcement may be "Game over, your penalty number is three," where the number three is a number randomly selected by the ball serving system.

As depicted in FIGS. 26 thru 28, penalty labels may be listed between two border lines that are spaced apart to match the width of a ball. The label may then be affixed to the clear tube 2310. The position of the last ball of the losing team/player under the label in the clear tube 2310 may indicate the penalty of the losing team/player. The nature of the penalty may vary according to the purpose of the game. FIG. 26 illustrates a table of penalties related to household chores for family use, while FIG. 27 illustrates a table of penalties of monetary donations for charitable events. Finally, FIG. 28 illustrates a list of penalties that may be used for parties.

To provide a greater variety and a more random selection of penalties, the label for the ball tube 2310 may be provided with any number of rows of penalties that are repeated in random order. To determine the penalty of a losing player/team, the clear tube 2310 is rotated (see FIG. 25) until the announced random penalty number three lines up with an indicator on the target bucket 2305. The position of the last ball in the tube 2310 then determines the suggested penalty.

The eighth selectable option shown in FIG. 4 is the "Shooter Pong (SP)" or single player mode. In this mode, the ball serving system activates only one serving gun so that a single player can practice hitting balls into the target bucket 2305.

Some of the above-described functions may be defined by instructions that are stored on storage media (i.e., non-transitory computer-readable storage media). The instructions may be retrieved and executed by the processor of the computer on which the system is resident. Some examples of storage media are memory devices, tapes, disks, integrated circuits, and servers. The instructions are operational when executed by the processor to direct the processor to operate in accordance with the invention. Those skilled in the art are familiar with instructions, processor(s), and storage media.

It should be noted that any hardware platform suitable for performing the processing described herein is suitable for use with the invention. The terms "computer-readable storage media" and "storage media" as used herein refer to any non-transitory medium or media that participate in providing instructions to a CPU for execution. Such media can take many forms, including, but not limited to, non-volatile media, volatile media, and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise an embodiment of a bus.

Common forms of computer-readable storage media include, for example, a floppy disk, a flexible disk, a hard disk, magnetic tape, any other magnetic medium, a CD-ROM disk, digital video disk (DVD), any other optical medium, a physical medium with patterns of marks or holes, a RAM, a PROM, an EPROM, an EEPROM, a FLASHEPROM, any other memory chip or cartridge, or any other storage medium from which a computer can read.

The embodiments described herein are illustrative of the present invention. As these embodiments of the present invention are described with reference to illustrations, various modifications or adaptations of the methods and or specific structures described may become apparent to those skilled in the art in light of the descriptions and illustrations herein. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. An automated ball serving system for a table tennis game, the system comprising:

a queuing device for holding a plurality of table tennis balls;

at least one serving gun comprising a propulsion device to propel a ball provided by the queuing device, the ball being propelled from an outlet of the serving gun toward one of a plurality of serve receiving areas of a table tennis table; and a paddle including a remote control device to control the system.

2. The ball serving system of claim 1, wherein the system comprises a plurality of serving guns, each serving gun being directed toward a different serve receiving area.

3. The ball serving system of claim 2, wherein multiple serving guns are served by a single queuing device.

4. The ball serving system of claim 1, wherein the velocity at which the ball is served by the serving gun is randomly varied by the ball serving system.

5. The ball serving system of claim 1, wherein the table includes at least one sensor that detects vibration in the table, wherein the vibration data detected by the sensor is used to determine a landing point of the served ball.

6. The ball serving system of claim 1, wherein the propulsion device of the serving gun is a rotating wheel and wherein the serving gun includes a sensing device to measure the RPM of the rotation of the wheel.

7. The ball serving system of claim 6, wherein the sensing device is a phototransistor, the phototransistor including a light source, the light being reflected off a mirror affixed to the wheel and detected by the phototransistor.

8. The ball serving system of claim 1, wherein the serving gun is rotatably mounted on the table, and wherein a stepper motor controlled by the system rotates the serving gun, the direction in which the serving gun is aimed being randomly determined by the ball serving system.

9. The ball serving system of claim 1, further comprising an automated scoring device to automatically track a score of a table tennis game in progress.

10. The ball serving system of claim 1, wherein the serving gun is a free standing device positioned proximate to the table.

11. The ball serving system of claim 1, further comprising at least one target device mounted on the table, the target device receiving balls propelled by a user.

12. The ball serving system of claim 11, further comprising a collection device coupled to the target device, wherein the collection device allows a user to visually determine a number of balls in the collection device.

13. The ball serving system of claim 1, wherein the ball serving system tracks a score so that each served ball is directed to a correct serve receiving area.

14. The ball serving system of claim 13, wherein the score is tracked for a singles game with two players.

15. The ball serving system of claim 13, wherein the score is tracked for a doubles game with four players.

16. An automated ball serving system for a table tennis game, the system comprising:

at least one queuing device for holding a plurality of table tennis balls; and a plurality of serving guns, each serving gun comprising a propulsion device to propel a ball provided by a queuing device, at least one serving gun being mounted adjacent each end of a table tennis table, and each serving gun being directed toward a serve receiving area at an opposite end of the table tennis table.

17. The ball serving system of claim 16, wherein the system is controlled by a remote control device.

18. The ball serving system of claim 17, wherein the remote control device is contained in a paddle.

19. The ball serving system of claim 16, wherein the velocity at which the ball is served by a serving gun is randomly varied by the ball serving system.

20. The ball serving system of claim 16, wherein the table includes at least one sensor that detects vibration in the table, wherein the vibration data detected by the sensor is used to determine a landing point of the served ball.

21. The ball serving system of claim 16, wherein the plurality of serving guns consists of two serving guns, one being mounted adjacent each end of a table tennis table with each serving gun being directed toward a serve receiving area at an opposite end of the table tennis table.

22. The ball serving system of claim 21, wherein the plurality of serving guns comprises four serving guns, with two serving guns being mounted adjacent each end of a table tennis table with each serving gun being directed toward a serve receiving area at an opposite end of the table tennis table.

23. The ball serving system of claim 16, wherein the direction in which the ball is served by a serving gun is randomly varied by the system.

24. The ball serving system of claim 16, wherein each serving gun is rotatably mounted on the table, and wherein a stepper motor controlled by the system rotates the corresponding serving gun, the direction in which the serving gun is aimed being randomly determined by the system.

25. The ball serving system of claim 16, further comprising an automated scoring device to automatically track a score of a table tennis game in progress.

26. The ball serving system of claim 16, wherein each serving gun is a free standing device positioned proximate to the table.

27. The ball serving system of claim 16, wherein multiple serving guns are served by a single queuing device.

28. The ball serving system of claim 16, wherein the plurality of serving guns are served by multiple queuing devices.

29. The ball serving system of claim 16, further comprising at least one target device mounted on the table, the target device receiving balls propelled by a user.

30. The ball serving system of claim 29, further comprising a collection device coupled to the target device, wherein the collection device allows a user to visually determine a number of balls in the collection device.

31. The ball serving system of claim 16, wherein the ball serving system tracks a score so that each served ball is directed to a correct serve receiving area.

32. The ball serving system of claim 31, wherein the score is tracked for a singles game with two players.

33. The ball serving system of claim 31, wherein the score is tracked for a doubles game with four players.

* * * * *